US009076353B1

(12) United States Patent
Delaney, Jr.

(10) Patent No.: US 9,076,353 B1
(45) **Date of Patent: *Jul. 7, 2015**

(54) FLAG PROTECTION ASSEMBLY WITH FLAG EXTENDING DEVICE

(71) Applicant: Leslie Milas Delaney, Jr., Tinley Park, IL (US)

(72) Inventor: Leslie Milas Delaney, Jr., Tinley Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/271,965

(22) Filed: May 7, 2014

Related U.S. Application Data

(63) Continuation-in-part of application No. 13/986,093, filed on Mar. 30, 2013, now Pat. No. 8,776,714.

(51) Int. Cl.
*G09F 17/00* (2006.01)
*B65D 30/00* (2006.01)

(52) U.S. Cl.
CPC ..... *G09F 17/00* (2013.01); *B65D 31/00* (2013.01)

(58) Field of Classification Search
CPC ..... G09F 7/18; G09F 2007/1843; G09F 2007/1847; G09F 2007/1856; G09F 2007/186; G09F 17/00; G09F 2017/0008; G09F 2017/0041; G09F 2017/005; G09F 2017/0058
USPC ..... 116/173, 174, 175; 160/19, 23.1, 24, 160/25, 32, 34, 368.1; 40/557, 604, 606.01, 40/607.02, 610, 611.01, 611.05, 611.06, 40/611.09, 611.1, 611.12, 617, 649, 661, 40/661.11, 664; 428/13, 14; D6/661.1; D11/165, 181
See application file for complete search history.

(56) References Cited

U.S. PATENT DOCUMENTS

| | | | |
|---|---|---|---|
| 473,503 | A | 4/1892 | Herring |
| 1,216,015 | A | 2/1917 | Tichenor |
| 1,228,092 | A | 5/1917 | Brewer |
| 1,355,861 | A | 10/1920 | Spaulding |
| 2,052,771 | A | 9/1936 | Johnson |
| 2,304,743 | A | 12/1942 | Schott |
| 2,506,209 | A | 5/1950 | Glass |
| 2,656,869 | A | 10/1953 | Timmons |
| 3,042,940 | A | 7/1962 | Keaton |
| 4,574,726 | A | 3/1986 | Sullivan |
| 4,793,082 | A | 12/1988 | Petrick et al. |

(Continued)

FOREIGN PATENT DOCUMENTS

| | | | | |
|---|---|---|---|---|
| ES | 2020452 A | * | 8/1991 | ..... G09F 17/00 |
| JP | 08006516 | | 1/1996 | |

(Continued)

*Primary Examiner* — Richard A Smith
(74) *Attorney, Agent, or Firm* — Depeng Bi; The Law Offices of Konrad Sherinian, LLC

(57) ABSTRACT

Herein is described my flag protection assembly that prevents flag deterioration from heat, humidity, wind, rain and other adverse environmental conditions. In some embodiments the flag protection assembly also prevents flag deterioration from ultraviolet light. My flag protection assembly does not require motorized, computerized or other electrical components to fully extend the flexible covering and enclosed flag from a support. My flag protection assembly preferably includes a flexible cover through which a short rod initially inserts. A flag is coiled around this short rod and the rod is then placed within the upper interior of the flexible cover. The flag is thereafter uncoiled within the flexible cover while the rod is removed through an opening in the bottom edge of the flexible cover.

9 Claims, 19 Drawing Sheets

(56) References Cited

U.S. PATENT DOCUMENTS

| | | | | |
|---|---|---|---|---|
| 4,967,685 | A | 11/1990 | Beck | |
| 5,092,066 | A | 3/1992 | Brewster | |
| 5,291,849 | A | 3/1994 | Zeitler | |
| 5,400,437 | A | 3/1995 | Koutras | |
| 5,893,226 | A * | 4/1999 | Sophocleous et al. | 40/591 |
| 6,163,899 | A * | 12/2000 | Leonard | 4/558 |
| 6,523,288 | B1 * | 2/2003 | Sackett | 40/539 |
| 6,895,704 | B2 * | 5/2005 | Ives et al. | 40/493 |
| 6,976,786 | B1 | 12/2005 | Stanley | |
| 7,086,190 | B2 * | 8/2006 | Voluckas | 40/617 |
| 7,159,347 | B1 * | 1/2007 | Ngan | 40/514 |
| 7,424,864 | B2 | 9/2008 | McCann | |
| 7,823,309 | B2 * | 11/2010 | Albenda | 40/610 |
| 7,841,117 | B2 | 11/2010 | Smith | |
| 8,776,714 | B1 * | 7/2014 | Delaney, Jr. | 116/173 |
| 2006/0065182 | A1 * | 3/2006 | Campbell et al. | 116/174 |
| 2007/0011927 | A1 * | 1/2007 | Zheng | 40/610 |
| 2009/0100730 | A1 * | 4/2009 | Nathanson et al. | 40/641 |
| 2012/0167815 | A1 | 7/2012 | Tait | |

FOREIGN PATENT DOCUMENTS

| | | | | |
|---|---|---|---|---|
| JP | 2005141097 | | 6/2005 | |
| JP | 2009104094 | A * | 5/2009 | G09F 7/18 |
| JP | 3158625 | | 4/2010 | |
| WO | WO 0054245 | A1 * | 9/2000 | G09F 17/00 |
| WO | WO 2006102293 | A2 * | 9/2006 | G09F 1/06 |

* cited by examiner

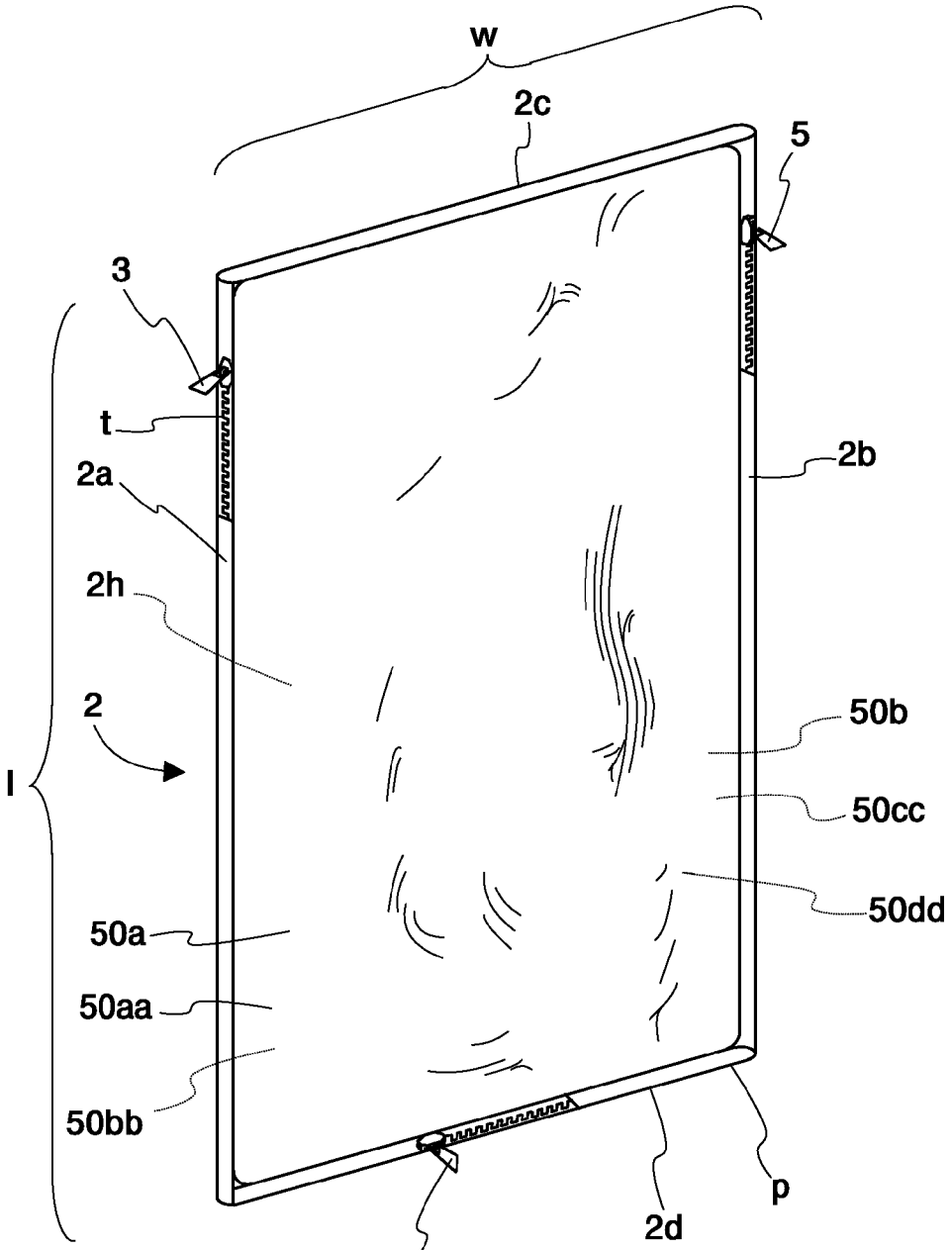
Fig. 1
Fig. 1A
PRIOR ART
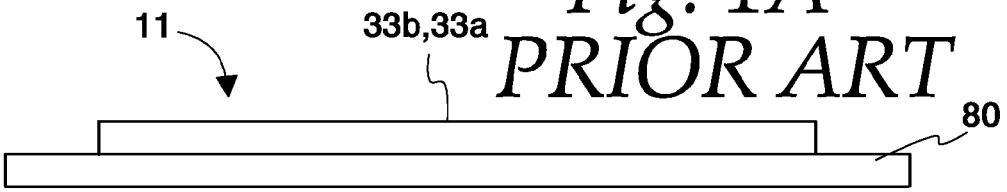

Fig. 3A
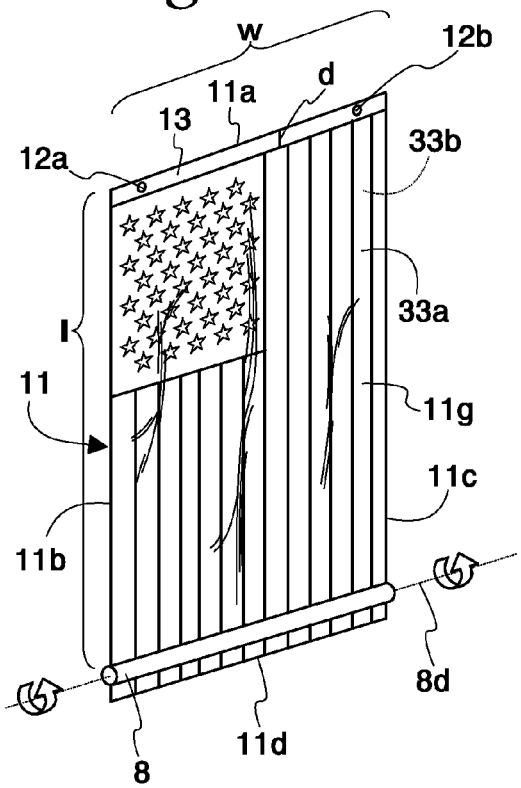
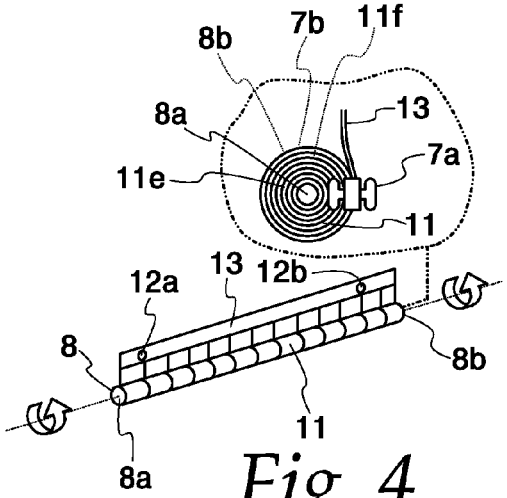
Fig. 4
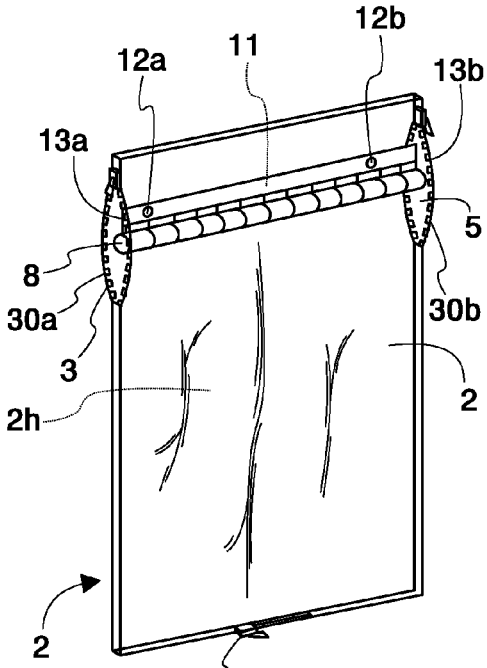
Fig. 5

Fig. 6B
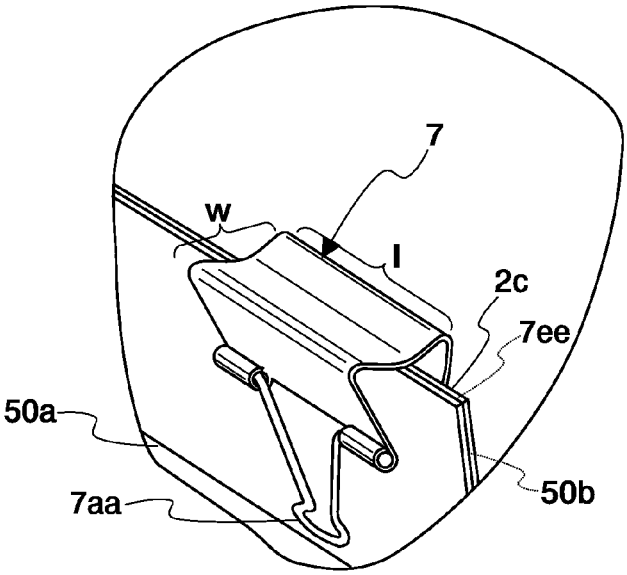
Fig. 7
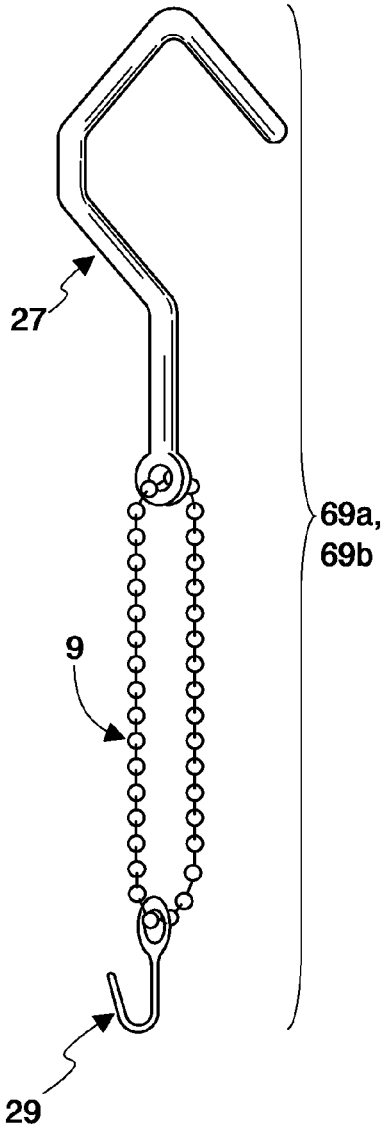
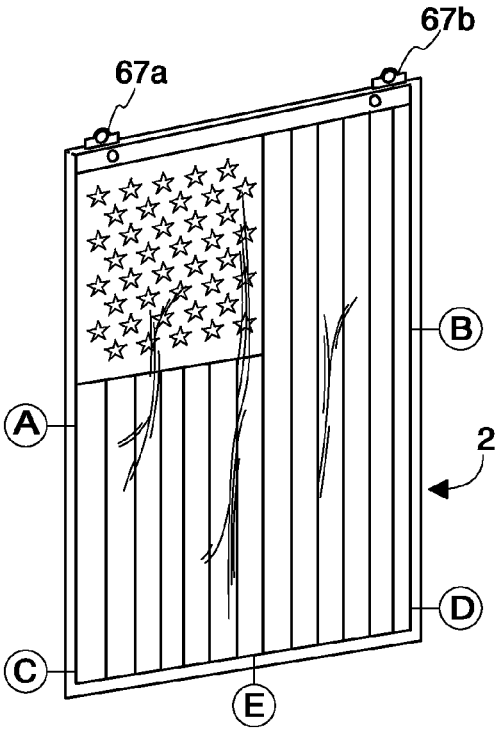
Fig. 6C

Fig. 8B
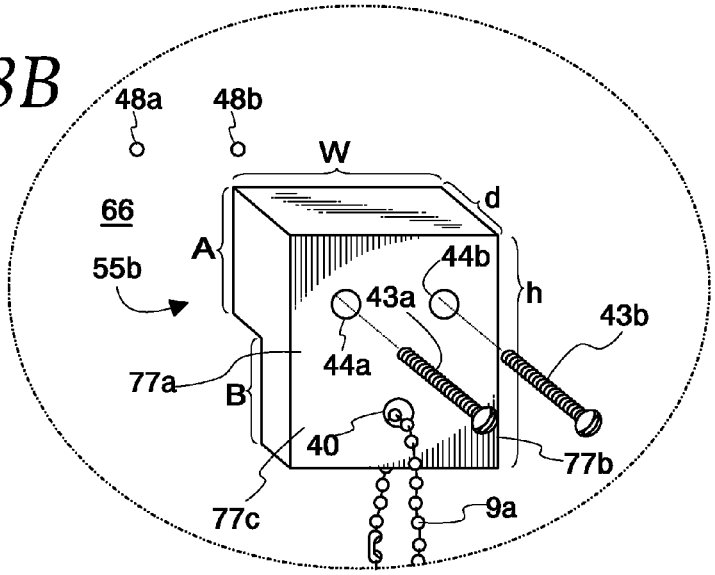
Fig. 8D
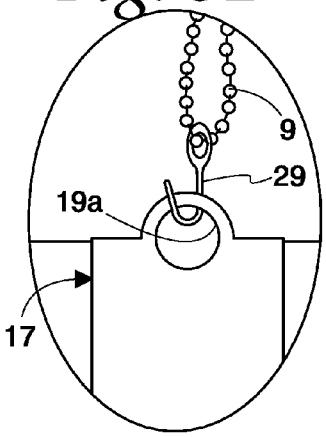
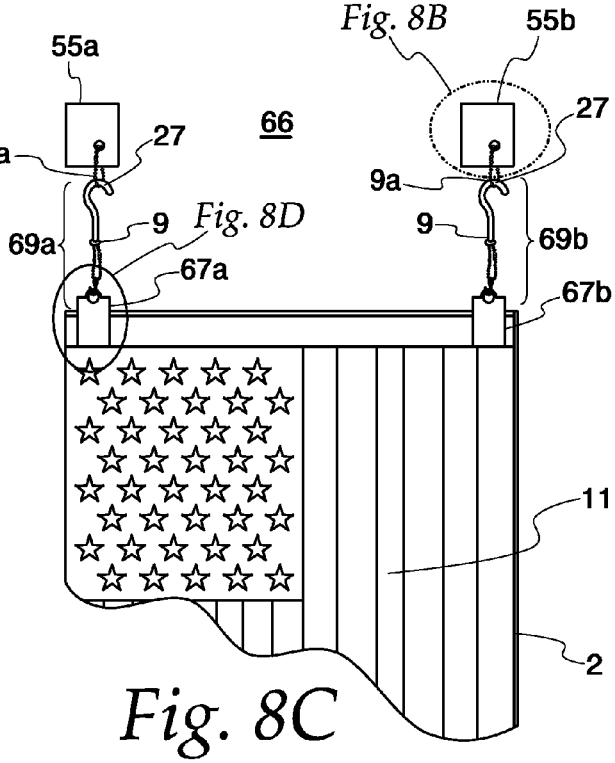
Fig. 8C

Fig. 8H
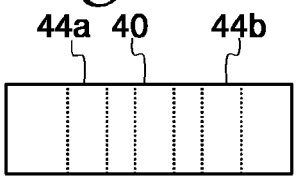
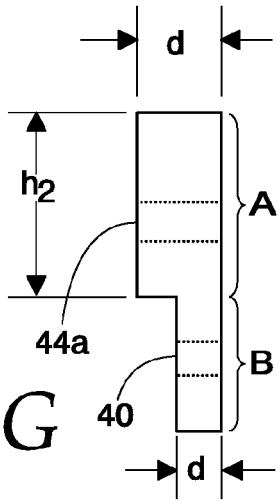
Fig. 8G
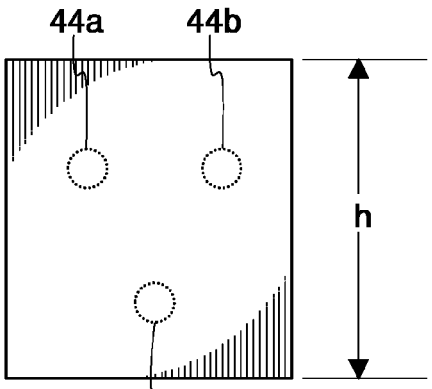
Fig. 8F
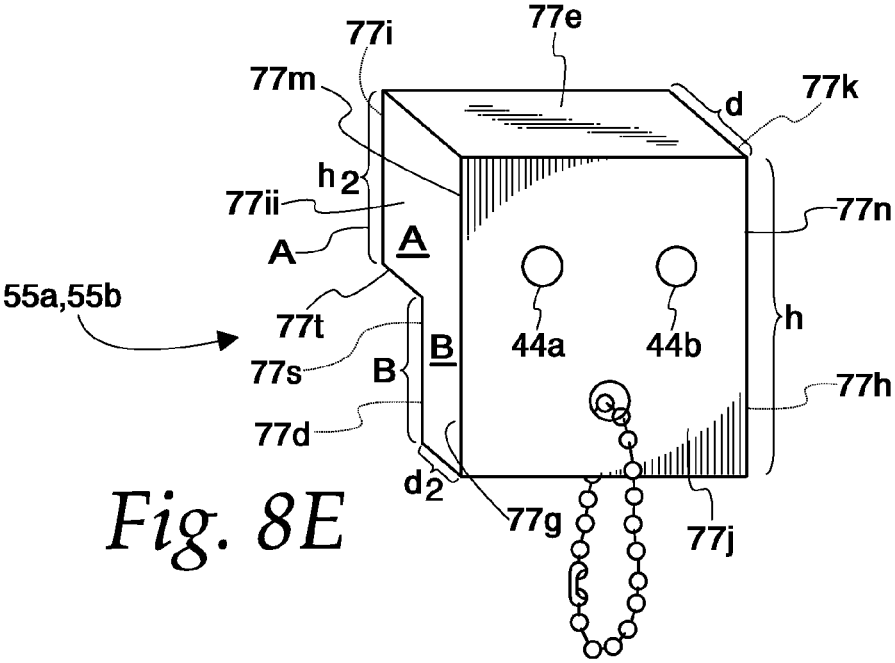
Fig. 8E

Fig. 10
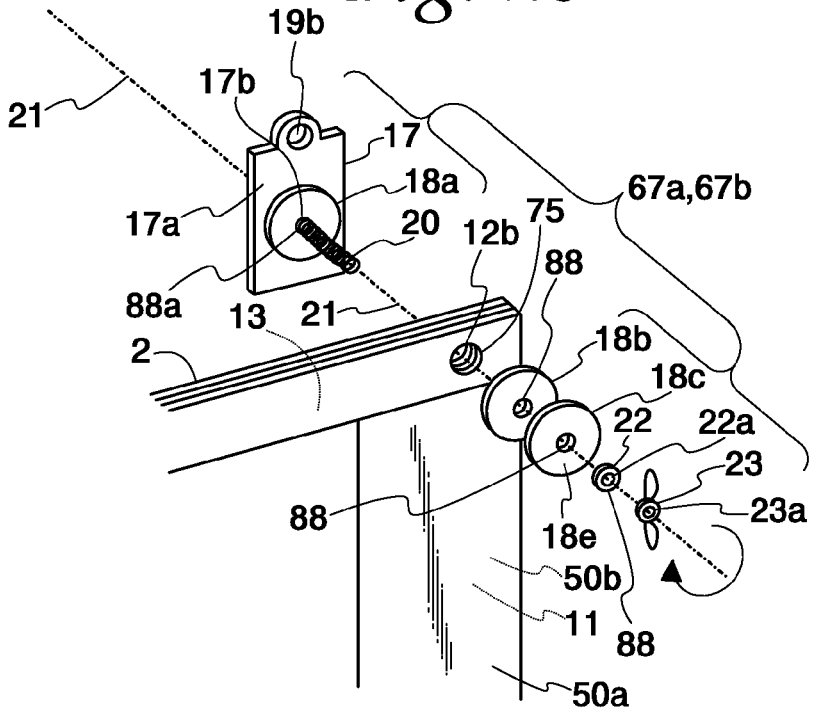
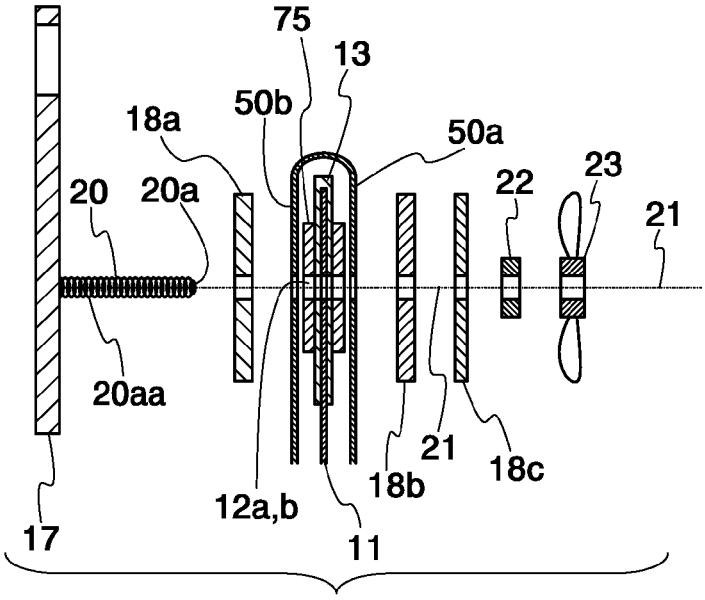
Fig. 11A
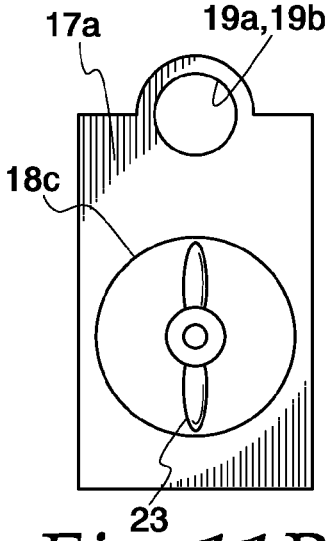
Fig. 11B

Fig. 12BB
PRIOR ART
Fig. 12B
PRIOR ART
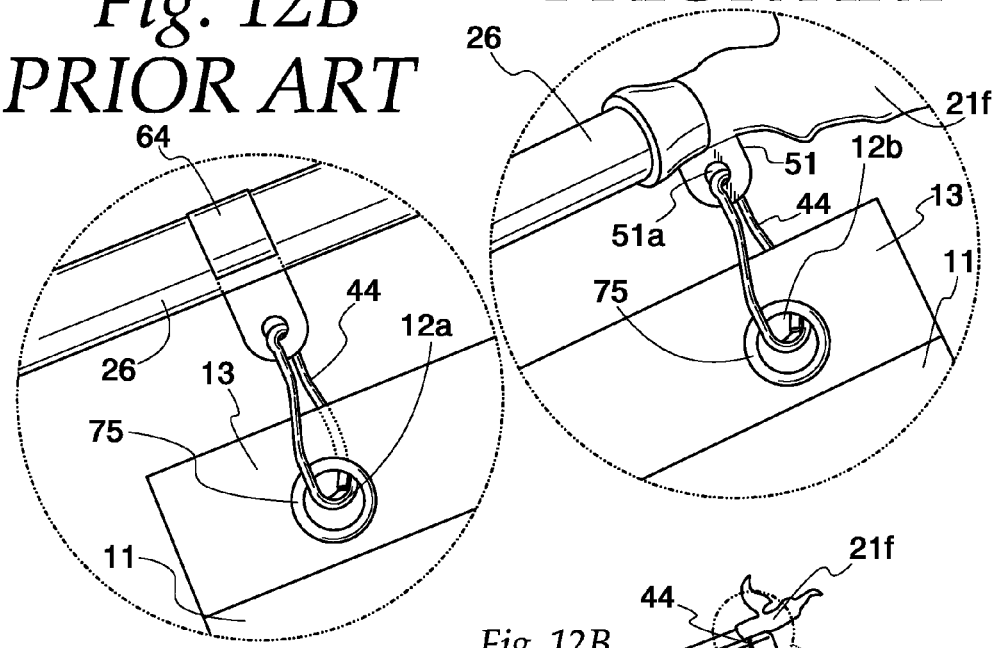
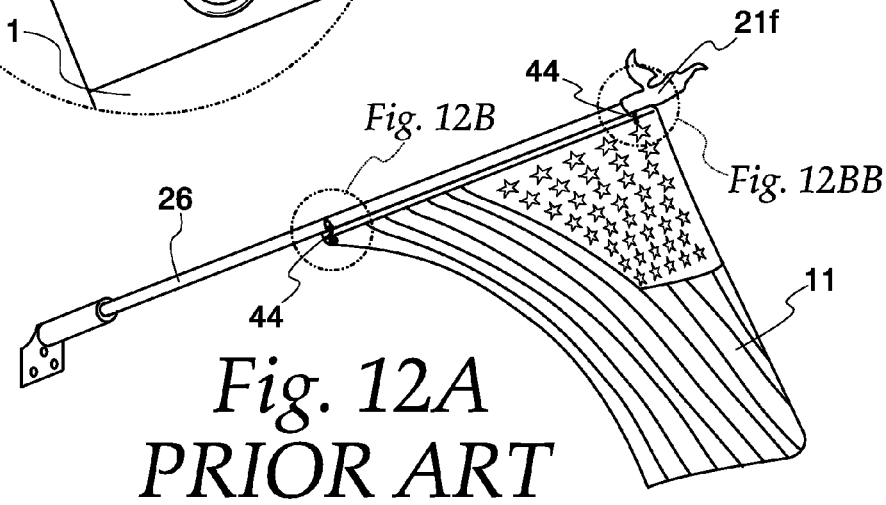
Fig. 12A
PRIOR ART
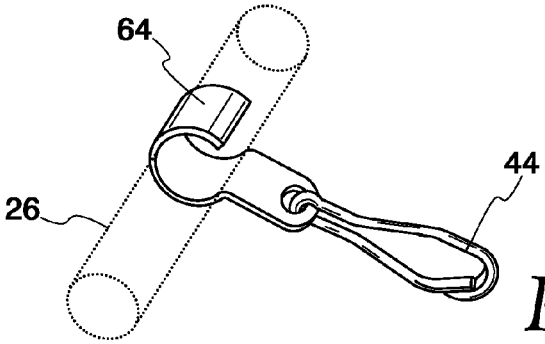
Fig. 12C
PRIOR ART Fig. 13AA
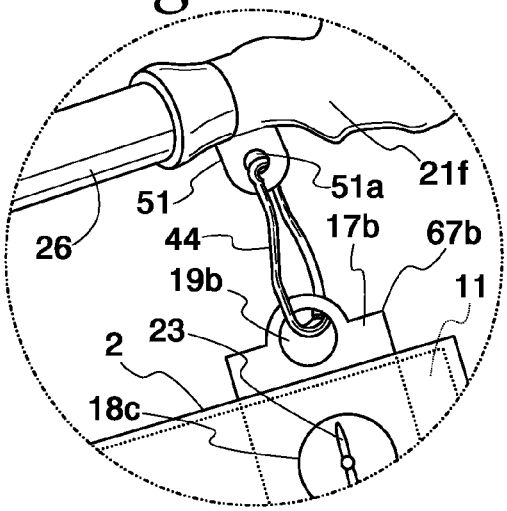
Fig. 13A
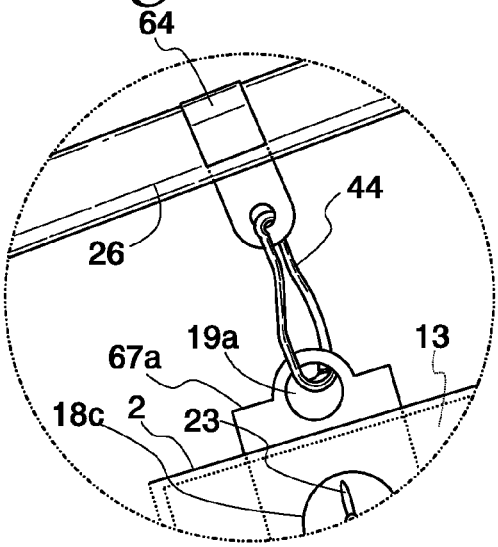
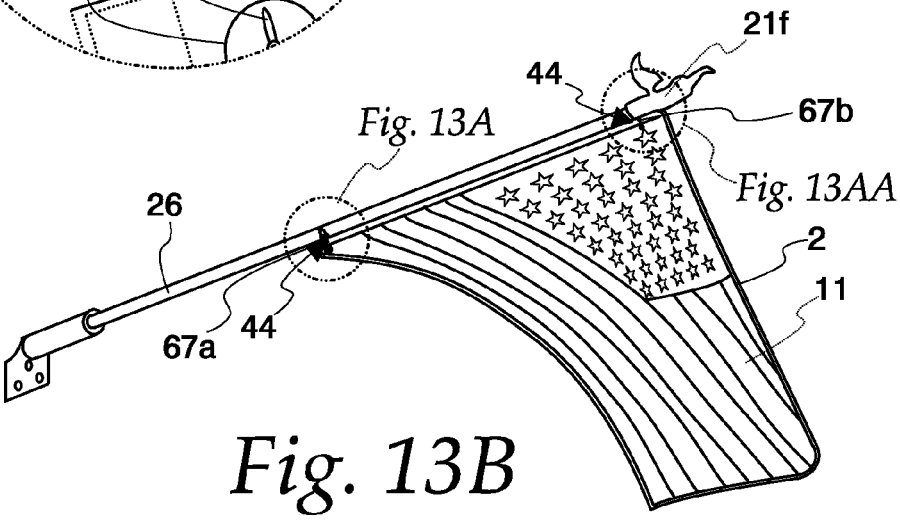
Fig. 13B
Fig. 14
PRIOR ART
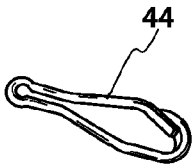

FLAG PROTECTION ASSEMBLY WITH FLAG EXTENDING DEVICE

CROSS-REFERENCE TO RELATED APPLICATIONS

This application is a continuation-in-part of U.S. patent application Ser. No. 13/986,093, entitled "FLAG PROTECTION ASSEMBLY," filed Mar. 30, 2013, amended Jul. 24, 2013, which is hereby incorporated by reference in its entirety, and which is a continuation of U.S. Patent Provisional Application No. 61/743,001, which is a continuation of U.S. Patent Provisional Application No. 61/573,464, which is a continuation of U.S. Patent Provisional Application No. 61/462,106.

FIELD OF THE DISCLOSURE

The present invention relates generally to a flag and is particularly directed to a flag protection assembly with a flag extending assembly.

DESCRIPTION OF BACKGROUND

This invention relates to the field of devices for protecting a flag, pennant, banner or other similar or flag-like article [hereinafter collectively referred to as ' flag' or 'flags'] from weather as well as other damage and wear. In particular this invention relates to an assembly which (i) completely encloses a flag or flag-like article and (ii) is sufficiently flexible and strong to withstand wind and rain damage when attached to a flag support and (iii) can indefinitely suspend from horizontal or protruding support(s).

This invention also relates to a device that comprises a component, such as a short rod, around which (i) the flag initially coils and (ii) from which the flag uncoils while enclosed within an enclosing flexible cover. This assembly also relates to devices by which the flag enclosed within the flexible cover reversibly attaches to (i) a protruding support or (ii) two opposing substantially horizontal surfaces or a horizontal support or surface that is substantially parallel to a supporting surface; or (iii) hangs horizontally from wall connectors attached to a substantially upright surface. In these second and third scenarios, the flag hangs downward from either the horizontal surfaces or wall connectors.

Previous flag devices and/or assemblies do not combine or contain the flexible attaching cover, method of flag enclosure, or attachments to a support that my device comprises. For example, U.S. Pat. Pub. No. US 2012/0167815 A1 (Tait) disclose a flag storage device with an aperture that opens and closes with a retracting shutter. U.S. Pat. No. 7,424,864 B2 (McCann) discloses a flag kit with braces that operates to maintain the flag in a fixed extended position. U.S. design Pat. No. US D473, 503 discloses a transparent United States flag license plate cover. U.S. Pat. No. 1,228,092 (Brewer) discloses a flag cover that furls around a vertical pole, or in the alterative encloses a vertical pole directly below the flag whenever the flag is in an unrolled extended position.

U.S. Pat. No. 4,967,685 (Beck) discloses a device mounted upon the edge of the flag most proximal to a vertical pole support. This device is rigid and extends laterally from the pole a distance of one-twelfth of the flag's width. This device deflects a portion of wind and thereby minimizes the wind's snapping effect at the flag's exterior distal edge. U.S. Pat. No. 5,291,849 (Zeitler) discloses a flag support with a furl preventer. His components include (i) a base support for maintaining the flag's exterior edge in an extended position and (ii) an adjustable length deflector element. By adjusting the distance between the free end of the deflector and the lower flag edge, the support assembly accommodates numerous flag sizes and diverse support angles. The device also prevents the flag from wrapping around the supporting structure.

None of above devices protects a flag from dirt and weather damage in a straightforward manner as does my disclosed flag protection assembly. In another embodiment my devices protects a flag from ultra-violet light damage as well. In my invention a flexible covering protectively seals and encloses a flag for outdoor display over an extended time. This flexible covering also extends the flag's life, blocks contaminants and preserves flag aesthetic qualities for a minimum cost. The above devices further fail to provide an assembly for extending the flag within a flag cover. Accordingly there is a need for an assembly for efficiently extending the flag inside the flag cover, and a convenience board for extending the flag inside the flag cover.

OBJECTS OF THE DISCLOSED SYSTEM, METHOD, AND APPARATUS

Accordingly, it is an object of this disclosure to provide a flag protection assembly.

Another object of this disclosure is to provide a flag protection assembly including a set of clamps for maintaining the flag in an extended position and a set of fastening devices preventing the set of clamps from falling off.

Another object of this disclosure is to provide a flag protection assembly incorporating an assembly for extending the flag inside the flag cover.

Another object of this disclosure is to provide a foldable board for setting up a flag protection assembly.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

The flag protection assembly described herein comprises a flexible cover which is preferably in the shape of a rectangle when completely empty, collapsed and flat. This flexible cover preferably contains an opening along its bottom edge and a single lateral opening along each of its two lateral edges. Most preferably the flexible cover is a flat double sided rectangular bag equipped with zippers for opening and closing each opening, and with the two lateral openings being horizontally aligned with and opposing each other. The flag to be enclosed preferably comprises two flag eyelets near the upper flag edge that is most proximal to the flag support. Generally the flag support is, but not necessarily, a protruding pole, a horizontally aligned support, two opposing horizontal surfaces, or two wall connectors attaching to a substantially upright surface. The flexible cover is preferably transparent, flexible and disposable unless the embodiment comprises a material that is resistant to ultra violet light damage.

My flag protection assembly also preferably includes a short rod around which the flag completely coils (i) prior to insertion into the flexible cover through (ii) the two laterally aligned openings along the flexible cover edges. Each laterally aligned opening is located along a corresponding single lateral edge of the flexible cover. Each laterally aligned opening preferably (i) directly opposes the remaining laterally aligned opening at the upper lateral edges of the flexible covering most proximal to the flag support (ii) when the flag protection assembly is completely assembled and attached to the flag support. Also preferably included within my flag protection assembly are sliding zippers that attach to, as well as open and close, the laterally aligned openings and bottom opening of the flexible cover. When attaching to a horizontal support(s) or wall connectors, my flexible cover (i) attaches to the enclosed flag with preferably five spring clamps along its distal bottom edge and both lateral edges (ii) to ensure the flag remains maximally extended within the flexible cover.

My novel retainer devices can attach the enclosed flag and corresponding enclosing flexible cover to protruding or horizontal supports or wall connects in combination with supplementary mechanical attaching components. In particular, along the upper proximal edge of this flexible cover, there are preferably at least two retainer devices that compress and retain the flexible cover and an enclosed flag to each other. Even more specifically, these retainer devices mechanically reversibly attach a flag within the flexible cover through two congruently aligned flag eyelets within the flag webbing. Even more particularly, the flag webbing at the upper proximal edge of an enclosed flag preferably contains two flag eyelets that preferably (i) horizontally align with each other and (ii) are each proximal to a corresponding lateral edge of the flexible covering.

Each single retaining device contains a single threaded pointed rod, a single posterior rectangular plate, a first circular pliable plate, second circular pliable plate, a circular anterior plate, a lock washer and a winged nut. Upon application each single threaded pointed rod initially severs one flexible cover longitudinal side, traverses an enclosed flag eyelet, and exits as the point cuts through the opposite flexible cover longitudinal side. Each winged nut is tightened along the threaded pointed rod to reversibly compress the flexible cover and enclosed flag together in a watertight seal between (i) the first circular pliable plate and (ii) second circular pliable plate. Retaining devices are preferably used when the enclosed flag and enclosing flexible cover hang from a protruding support, but these retaining devices are also similarly applied in other embodiments.

To use and assemble my flag protection assembly, the operator initially opens the laterally aligned opening zippers. The operator thereafter completely coils the flag longitudinally around the short rod beginning at the most distal edge of the flag. During this coiling process, the short rod is aligned perpendicular to the length of the flag. The operator continues this process until the flag is completely coiled around longitudinal axis of the short rod, except for the flag webbing which continuously protrudes along this longitudinal axis. Spring clamps are applied upon the coiled flag ends to maintain a temporary coiled flag configuration. The operator next inserts the single short rod with the coiled flag through the two opposing laterally aligned openings along each corresponding flexible cover lateral side. The insertion continues until the flag webbing is positioned snugly within the interior, and upper proximal comers of, the flexible cover. Spring clamps are next temporarily applied to the flag and flexible cover to hold the flag in place at the upper proximal edge of the flexible cover for retainer device application. The operator thereafter tightens a single retaining device through each of the two enclosed flag eyelets and enclosing flexible cover longitudinal sides.

Thereafter the operator removes the spring clamps previously applied at the coiled flag ends and allows the short rod to fall to the bottom of the flexible cover. As it falls, the enclosed flag rapidly uncoils until it extends to the bottom distal end of the flexible cover. At this point, the entire completely enclosed flag is now (i) flat (ii) completely extended longitudinally, and (iii) visible from either the posterior or anterior longitudinal sides of the flexible covering. For flags hanging from substantially horizontal support or wall connectors, multiple hook attachments can be applied along the upper proximal edges of the enclosed flag and flexible cover to mechanically engage (i) the horizontal support(s) or (ii) wall connectors. (12) For flags that hang from a substantially horizontal support(s) or wall connectors, the operator applies five prior art spring clamps along each lateral and distal bottom edge of the flexible covering to compress each flexible cover edge to a corresponding flag edge. The single short rod is also removed through the bottom distal opening within the flexible cover. All zippers are now closed and covered with transparent adhesive tape, thereby protectively sealing the flag within the flexible cover. To remove the enclosed flag from the interior of flexible cover, the operator loosens each winged nut of each retainer device and removes each retainer device from the enclosed flag eyelet. For flag protection assemblies that hang horizontally, the operator also removes the spring clamps that attach edges of the flexible cover to a corresponding edge of the enclosed flag. He or she thereafter pulls the enclosed flag through the zippered opening along the distal bottom edge of the flexible covering.

To attach the enclosed flag to a protruding support, my flag protection assembly preferably applies a prior art conventional flag clip that simultaneously connects to (i) cylindrical clamp encircling a protruding support and (ii) a prior art upper cap. A protruding support can be a flag pole that is attached to a wall or other substantially upright surface or structure. In horizontally aligned embodiments, my flag protection assembly comprises multiple hook supports, and these multiple hook supports simultaneously attach to retainer devices and a horizontal support. These horizontal supports may be (i) temporary in nature such as a shower rod, or (ii) permanent in nature such as my novel wall connectors. Spring clamps and retaining devices maintain an extended flag (i) within a flexible cover with (ii) the flag's anterior and posterior surfaces parallel to corresponding longitudinal posterior and anterior surfaces of this same flexible cover. My invention does not require motorized, electrical, software, other computer related devices, pulleys, levers or other components other than those disclosed in this application to optimally function to protect a flag in a cost-efficient manner.

Accordingly, it is one purpose of my invention to provide a flag protection assembly to protect the flag from environmental damage from, but not exclusively, weather, dirt, tattering and ultraviolet light.

It is another purpose of my invention to provide a flag protection assembly that is easily manually placed and or removed from a flag by a single person in a short period of time.

It is another purpose of my invention to provide a flag protection assembly that does not require numerous electrical, electronic, or other complex mechanized devices such as, but not exclusively, motors and pulleys and computer related articles.

It is another purpose of my invention to provide a flag protection assembly that is economical and disposable.

It is another purpose of my invention to provide a flag protection assembly with components by which to attach the flexible covering with an enclosed flag to a support(s).

These and other features are further illustrated in my DETAILED DESCRIPTION OF THE PREFERRED EMBODIMENT AND OTHER EMBODIMENTS and the DRAWINGS appended to this application.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 illustrates a partial anterior view of the preferred embodiment of the flag assembly flexible cover.

FIG. 1A illustrates a prior art flag lying flat upon a horizontal surface.

FIG. 3A illustrates a partial anterior view a prior art flag with flag webbing and a short rod positioned in the preferred embodiment.

FIG. 4 illustrates an isolated partial anterior longitudinal view of the coiled flag along the short rod of FIG. 3A, as well as a cross-sectional view of the flag completely coiled around a short rod with attaching spring clamps.

FIG. 5 illustrates a partial anterior view of the completely coiled prior art flag within the interior, and at the upper proximal edge, of the flexible cover.

FIG. 6B displays one of five spring clamps as applied at locations along the enclosed flag and enclosing flexible cover.

FIG. 6C illustrates the placement of five spring clamps along the enclosed flag and enclosing flexible cover.

FIG. 7 illustrates an isolated close up view of the multiple hook attachment for attaching the enclosed flag to horizontal support(s) or wall connectors.

FIG. 8B illustrates an exploded view of a wall connector with screws and apertures.

FIG. 8C illustrates the attachment of an enclosed flag with the enclosing flexible cover to a vertical support with wall connectors.

FIG. 8D illustrates an isolated close up view of a retaining device component attaching to a multiple hook attachment with the wall connector of FIG. 8B.

FIG. 8E illustrates an isolated wall connector in partial anterior view.

FIG. 8F illustrates the posterior surface of the wall connector of FIG. 8E.

FIG. 8G illustrates a lateral cut away view of the wall connector of FIG. 8E.

FIG. 8H illustrates a top plan view of the wall connector of FIG. 8E at the two connecting screw apertures.

FIG. 10 illustrates an exploded view of one retaining device in the preferred embodiment.

FIG. 11A illustrates a lateral exploded view of the retaining device in FIG. 10.

FIG. 11B illustrates an anterior isolated view of the retaining device of FIG. 10.

FIG. 12A illustrates a lateral view of the prior art attachments of a flag along a protruding support and a prior art upper cap.

FIG. 12B illustrates an anterior close up view of a prior art flag clip attaching a flag to a protruding support.

FIG. 12BB illustrates an anterior close up view of a prior art flag clip attaching a flag to a prior art upper support cap with a flag clip through a flag grommet.

FIG. 12C illustrates a close up isolated view of the prior art cylindrical flexible clamp and cylindrical support to which a prior art flag clip attaches.

FIG. 13A illustrates attachment of an enclosed flag and the enclosing flexible cover by a flag clip, a cylindrical flexible clamp and corresponding retaining device.

FIG. 13AA illustrates attachment of an enclosed flag and the enclosing flexible cover by a flag clip, retaining device, and upper support cap.

FIG. 13B illustrates a lateral view of an enclosed flag and flexible cover attaching to a protruding support with retaining devices.

FIG. 14 is an isolated close up view of a prior art flag clip.

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

I. Flag 11

Figure 3B:
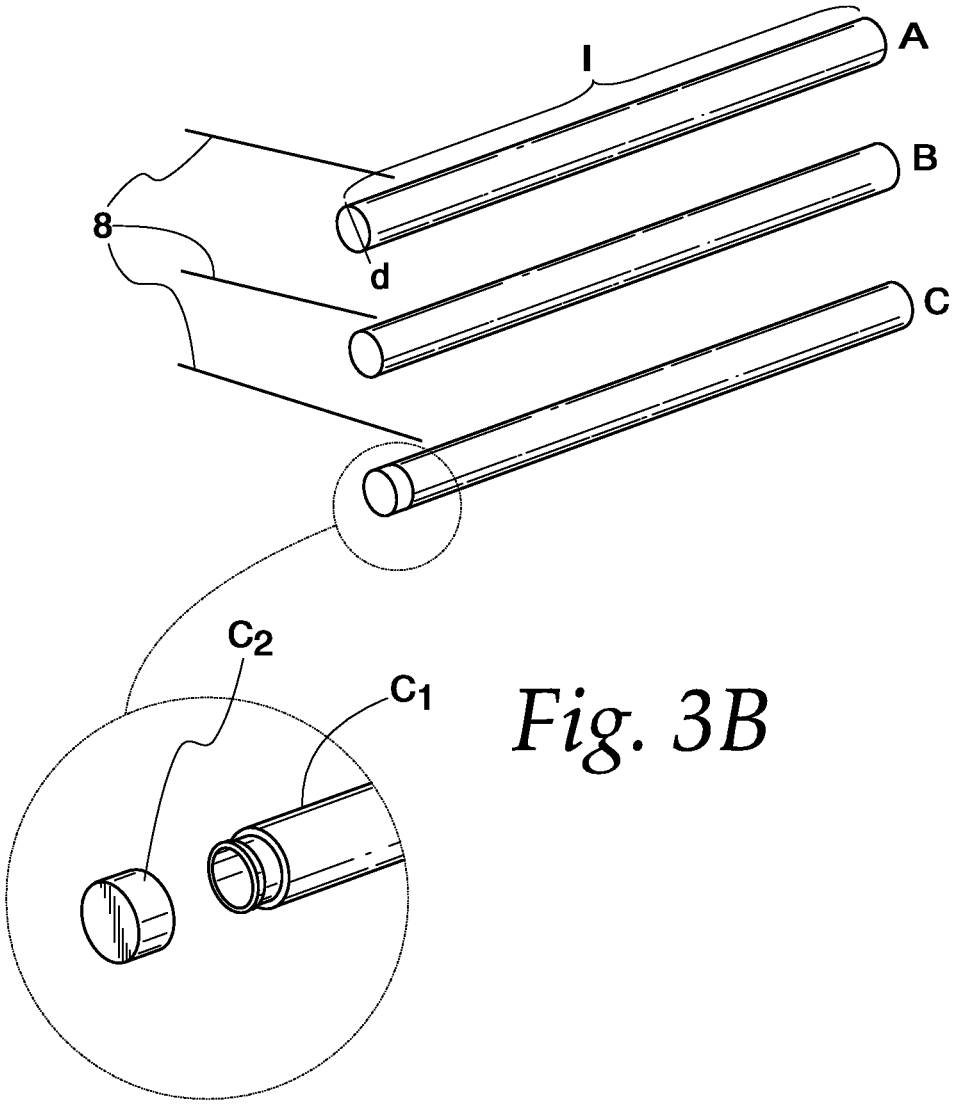
FIG. 3B illustrates several prototypes for the short rod of FIG. 3A.

Referring initially to FIG. 3A, in the preferred embodiment prior art flag 11 is generally rectangular and comprises a single upper proximal flag edge 11*a*. However, 10 other shapes, sizes and dimensions of flags are satisfactory in other embodiments, as well as other flag-like devices that may be developed in the future. The term "flag 11" for my invention includes articles such as, but not exclusively, banners, signs, or other devices with similar features and structure to a conventional flag. For balance, the dimensions of flag 11 should be directly proportional to the longitudinal length of a protruding support 15 26 whenever protruding support 26 comprises a pole. The popular standard size flag for residential use is preferably approximately five feet in length 1 and three feet in width w. Consequently, in the preferred embodiment flexible cover 2 must be larger than these specific dimensions.

Figure 9:
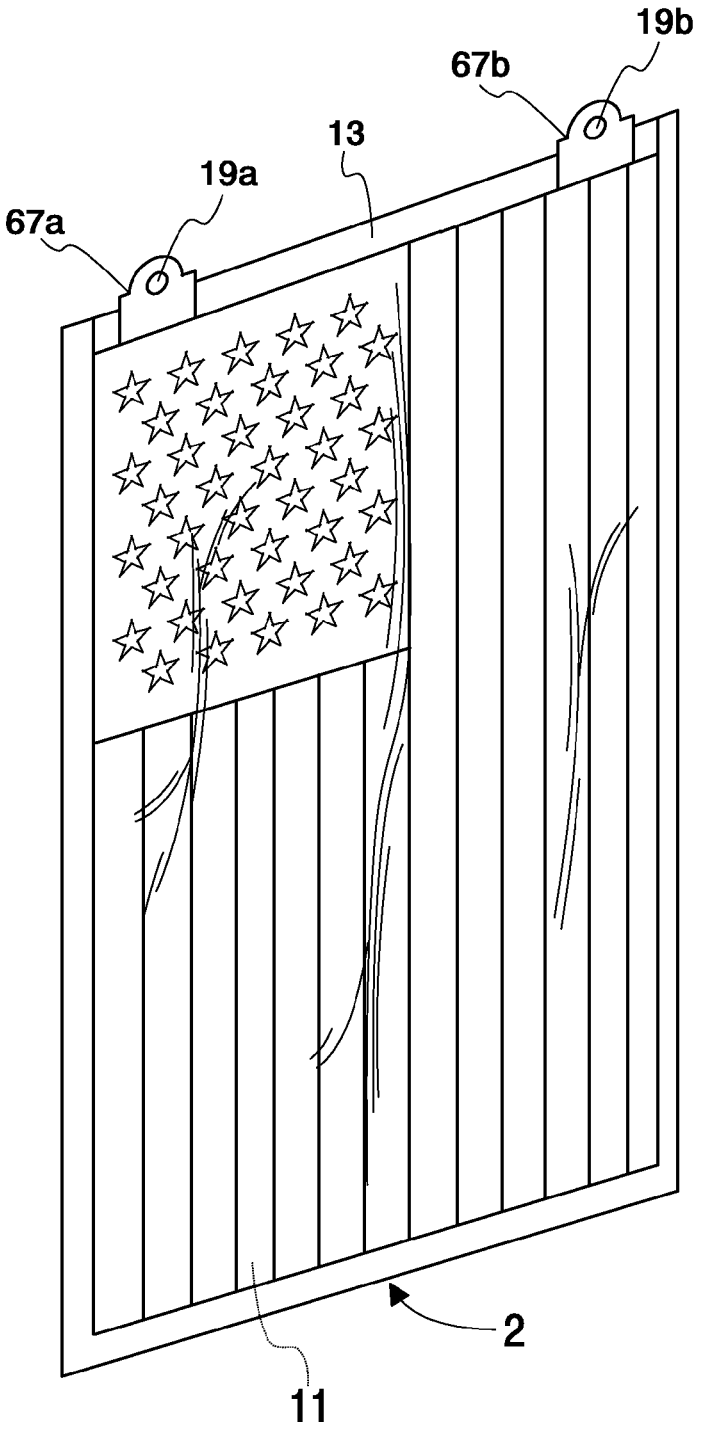
FIG. 9 illustrates a flag protection assembly with an enclosed flag and flag retainer devices.

Still referring to FIG. 3A, in the preferred embodiment flag webbing 13 is (i) coextensive widthwise and contiguous with flag body 11 *g*, and (ii) flag webbing 13 is immediately below, adjacent to, and contiguous with upper proximal flag edge 11*a*. Flag webbing 13 is preferably approximately (i) one and one-quarter inches in depth d and (ii) co-extensive in length 1 with width w of upper proximal flag edge 11*a*. Flag 11 also comprises a lower distal flag edge 11 *d*, as well as a first flag lateral edge 11 *b* and a second flag lateral edge 11*c*. Referring to FIG. 1A, flag 11 further comprises a first longitudinal flag surface 33*a* and a second flag longitudinal surface 33*b*, as shown supported upon a substantially flat horizontal surface 80. Upper proximal flag edge 11*a* is the edge is closest (most proximal) to flag support(s) 26, 54 or wall connectors 55 whenever flag protection assembly 1 is fully assembled as shown in FIGS. 6C and 9.

Referring to FIGS. 3A and 5, in the preferred embodiment flag webbing 13 contains first and second flag eyelets 12*a*, 12*b* respectively. Each flag eyelet 12*a*, 12*b* is preferably approximately one-half inch in diameter. Each flag eyelet 12*a*, 12*b* respectively is located preferably approximately (i) one-half inch from its corresponding most proximal lateral flag edge 11 *b*, 11 *c* respectively and (ii) one-half inch from upper proximal flag edge 11*a*. However, in other embodiment's flag eyelets 12*a*, 12*b* may be located in other positions. When flag 11 is fully extended within flexible cover 2, first and second flag eyelets 12*a*, 12*b* respectively are traversed by corresponding first and second retaining devices 67*a*, 67*b* respectively, as described infra.

In other embodiments, there are flag eyelets 12 of other shapes and dimensions, in diverse locations; or there are flags 11 without eyelets 12 or other numbers of eyelets 12. To accommodate all flags 11 with two flag eyelets 12*a*, 12*b* (or additional flag eyelets 12) flag protection assembly 1 preferably comprises first and second retainer devices 67*a*, 67*b* respectively for mechanical retention at any flag eyelet 12 location as described infra.

II. Flag Protection Assembly 1

A. Flexible Cover 2

Referring to FIG. 1, in its preferred embodiment flag protection assembly 1 comprises a single flexible cover 2. Flexible cover 2 is preferably a (i) rectangular shaped transparent flexible article (ii) in the configuration of a bag. Flexible cover 2 is preferably plastic and disposable, and empty flexible cover 2 can lie flat upon a substantially horizontal surface. However, in other embodiments flexible cover 2 may be other shapes, diverse dimensions and made of other materials. Flexible cover 2 can physically withstand extended adverse weather conditions (especially wind and rain), environmental contaminants and dirt. In other embodiments flexible cover 2 is made of a material that withstands ultraviolet light damage, in addition to exhibiting resistance to adverse weather conditions, physical environment stress, contaminants and dirt.

In the preferred embodiment, flexible cover 2 has a first longitudinal cover side 50*a* and an opposing second longitudinal cover side 50*b*. First longitudinal cover side 50*a* has a first longitudinal exterior surface 50*aa* and a first longitudinal interior surface 50*bb*. Similarly, second cover longitudinal side has a second interior longitudinal surface 50*cc* and a second exterior longitudinal surface 50*dd*. Flexible cover 2 also has a first flexible lateral edge 2*a*, a second flexible lateral edge 2*b*, a single upper flexible proximal edge 2*c* and a single flexible lower distal edge 2*d*. Cover edges 2*a*, 2*b* and 2*d* are formed by continuous integral attachment of first and second longitudinal sides 50*a*, 50*b* to each other along the perimeter p of each cover longitudinal side 50*a*, 50*b*. Flexible cover 2 also contains flexible interior space 2*h*, and space 2*h* is co-extensive with interior longitudinal surfaces 50*bb*, 50*cc*. Flexible cover 2 is preferably approximately (i) at least sixty inches in longitudinal length 1 (*ii*) at least thirty-six inches in width w and (iii) one-eighth inch in thickness t. In all embodiments' flexible cover 2 is always greater in length, width and depth than a completely extended flag 11 to be enclosed.

Figure 2:
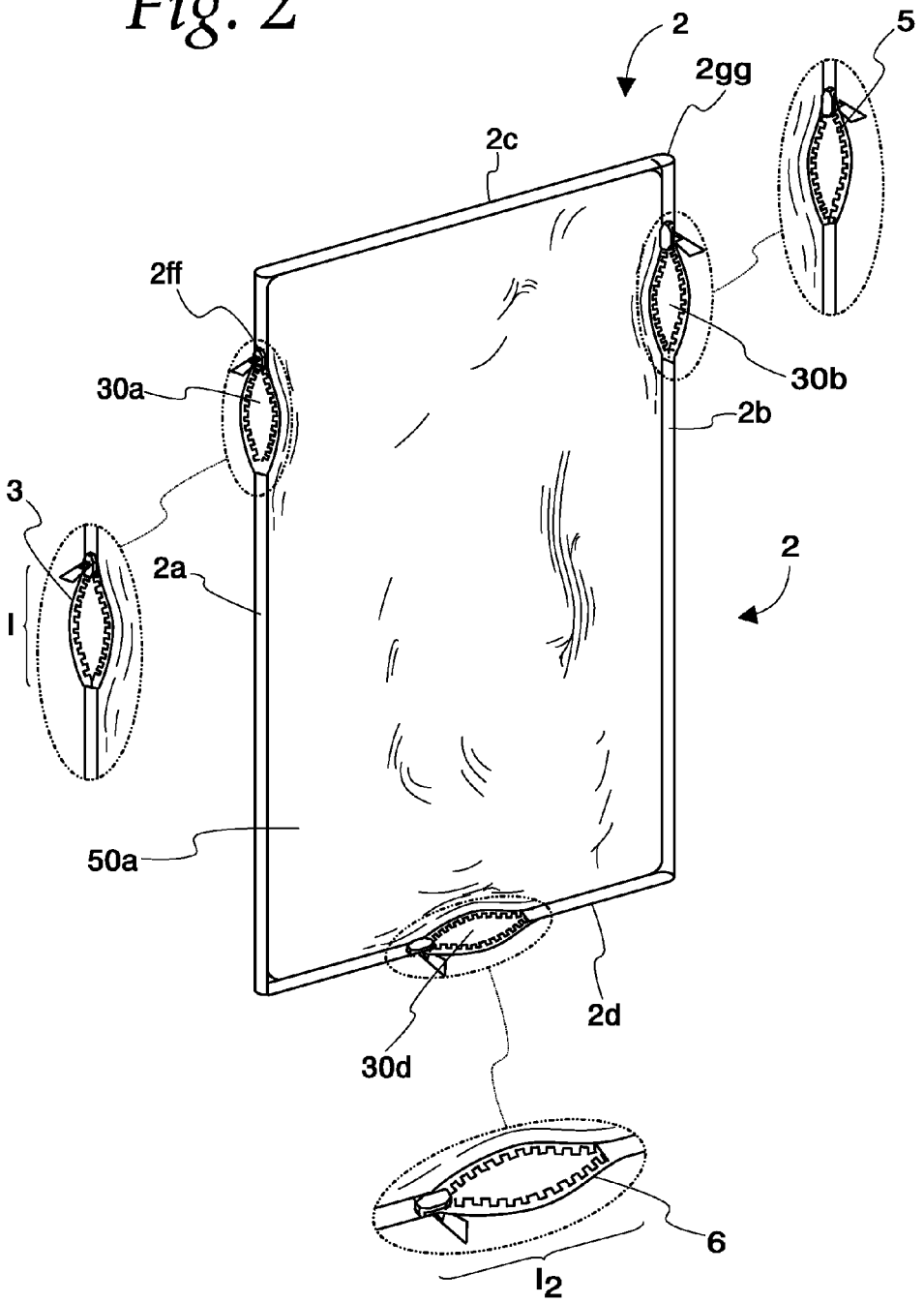
FIG. 2 illustrates a partial anterior view of the preferred embodiment of the flexible cover with three openings and close up views of the corresponding attached Zippers.

Upper proximal flexible cover edge 2*c* is designated as the edge closest, and most proximal, to flag support(s) 26, 54 or wall connectors 55 whenever flag protection assembly 1 is fully assembled and attached to (i) a protruding support 26, such as a cylindrical pole, that protrudes from a wall 66 or other upright surface or (ii) a horizontal support or supports 54 or (iii) wall connectors 55. In the preferred embodiment flexible cover 2 lacks eyelets 12. Referring to FIG. 2, preferably located immediately below upper flexible cover proximal edge 2*c* is first lateral longitudinal cover opening 30*a* and second lateral longitudinal cover opening 30*b*. Lateral longitudinal cover openings 30*a*, 30*b* respectively each preferably (i) align along corresponding first lateral flexible edge 2*a* and second lateral flexible edge 2*b* respectively and (ii) directly oppose each other.

Each lateral cover longitudinal opening 30*a*, 30*b* respectively is preferably approximately ten inches in longitudinal length 1 along each corresponding longitudinal flexible edge 2*a*, 2*b* respectively. Each cover longitudinal opening 30*a*, 30*b* respectively preferably reversibly opens and closes with a corresponding single first and second attached sliding zipper 3, 5 respectively. Each lateral cover longitudinal opening 30*a*, 30*b* respectively is adjacent to each corresponding first and second upper cover opening edge 2*ff*, 2*gg* respectively. Laterally aligned lateral cover openings 30*a*, 30*b* directly oppose each other in a parallel manner. Still referring to FIG. 2, located along lower distal flexible edge 2*d* is bottom distal cover opening 30*d*. Bottom distal opening 30*d* is preferably approximately ten inches in length hand centrally placed along lower distal edge 2*d*. Bottom distal opening 30*d* reversibly opens and closes with single attached sliding zipper 6. Flexible cover 2 lacks eyelets 12 in the preferred embodiment and some other embodiments.

B. Short Rod 8

Referring to FIGS. 3A, 3B, 4 and 5, flag protection assembly 1 preferably comprises a single short rod 8 with a longitudinal axis 8*d*. Single short rod 8 is preferably cylindrical and preferably approximately (i) twenty-four inches in length and (ii) one and one-quarter inches in diameter. Short rod 8 is preferably made of a flexible sponge-like material as best seen in Model A in FIG. 3B. However, in other embodiments, short rod 8 can be of other dimensions and shapes, as well as materials that are either flexible or rigid as depicted in Model B.

For example, short rod 8 may be a (i) solid plastic or a tube-like structure or (iii) a cylindrical bottle $C_1$ with a removable cap $C_2$ and containing water. For Model $C_1$, $C_2$, bottle $C_1$ (which may be plastic) can display arithmetic markings for the appropriate water volume (and weight) for the optimal weight of short rod 8 as related to the weight and length of flag 11. Specifically, the weight of short rod 8 can be adjusted to the optimum values for the most straightforward effective manner for uncoiling flag 11 as described infra. When short rod 8 bears flag 11 in a coiled configuration, short rod 8 can be inserted through either of open attached sliding zippers 3, 5. Preferably a coiled flag 11 is temporarily held in place upon short rod 8 with a first prior art spring clamp 7*c* and a second prior art spring clamp 7*d* respectively at first and second rod ends 8*a*, 8*b* respectively. Please see FIG. 4.

C. First and Second Retaining Devices 67*a*, 67*b*

In the preferred embodiment first and second retaining devices 67*a*, 67*b* respectively attach to flexible cover 2 through (i) along enclosed flag webbing 13 and (ii) corresponding first and second flag eyelets 12*a*, 12*b* respectively. Please see FIGS. 9, 10, 11A and 11B. Preferably (i) the structure, design and dimension of first retaining device 67*a* is identical to the structure design and dimensions of second retaining device 67*b*, and (ii) there are only two such retaining devices 67 for each flag protection assembly 1. As best seen in FIG. 10, each retaining device 67*a*, 67*b* preferably comprises (i) a single posterior rectangular plate 17 (ii) a single first circular pliable plate 18*a* (iii) a second circular pliable plate 18*b* (iv) a single circular anterior plate 18*c* (v) a single lock washer 22 (vi) a single wing nut 23, and (vii) a single short threaded pointed segment 20. First and second circular pliable plates 18*a*, 18*b* respectively and circular anterior plate 18*c* each engage short threaded pointed segment 20 through centers 88*a*, 88, 88 respectively, as described in more detail infra. Circular pliable plates 18*a*, 18*b* respectively are preferably positioned posterior and anterior respectively to each enclosed flag eyelet 12*a*, 12*b* (as the case may be) and enclosing flexible cover 2. Each plate 18*a*, 18*b* is also adjacent to either of enclosed flag eyelet 12*a* or 12*b* in a fully assembled flag protection assembly 1. Posterior rectangular plate 17 is preferably rectangular but can be other shapes in other embodiments.

In these anterior and posterior positions, circular pliable plates 18*a*, 18*b* seal a single threaded pointed segment 20 when segment 20 traverses (i) flag eyelet 12*a* or 12*b* and (ii) cover anterior and posterior longitudinal sides 50*a*, 50*b* respectively. Please see FIG. 11A. Circular pliable plates 18*a*, 18*b* are each preferably made from flexible plastic, rubber or materials with similar pliable flexible properties. These materials are preferable to rigid plastic or other rigid substances, in order to provide an optimally reliable weatherproof seal. Posterior rectangular plate 17 and circular anterior plate 18*c* are each preferably made of metal.

Each first and second circular pliable plates 18*a*, 18*b* is preferably approximately one and one-quarter inches in diameter and one-eighth inch in thickness. Circular anterior plate 18*c* is preferably approximately (i) one and one-quarter inches in diameter and (ii) one-sixteenth inch in thickness. Posterior rectangular plate 17 is preferably approximately (i) two and one-half inches in length, (ii) one and one-half inches in width, and (iii) one-eighth inch in thickness. Each single posterior rectangular plate 17 comprises single short threaded pointed segment 20. Segment 20 preferably protrudes (i) anterior from the centrally located middle point 17*b* of anterior surface 17*a* of single posterior rectangular plate 17 (ii) at an angle of approximately ninety degrees.

Wing nut 23 and lock washer 22 attach through their respective centers 23*a*, 22*a* to short threaded pointed segment 20 distal to circular anterior plate exterior surface 18*e*. Each of first and second single posterior plates 17*a*, 17*b* respectively preferably comprises a first and second continuous retainer upper opening 19*a*, 19*b* respectively. Each first and second retainer upper opening 19*a*, 19*b* respectively is preferably integrally formed by an upper extension of the corresponding posterior plate 17. Each retainer upper opening 19*a*, 19*b* is preferably approximately seven-sixteenths inches in diameter. Each retainer upper opening 19*a* is preferably identical to opening 19*b* in structure, dimensions, design, and all other aspects.

Referring to FIGS. 10 and 11A, each single short threaded pointed segment 20 can sever and penetrate flexible cover posterior longitudinal side 50*b* to (i) traverse either eyelet 12*a* or 12*b* and (ii) penetrate flexible cover anterior longitudinal side 50*a* (or in reverse order). As a result flexible cover sides 50*a*, 50*b* tightly compress enclosed flag webbing 13 and flag eyelets 12*a*, 12*b* between first and second circular pliable plates 18*a*, 18*b*. This compression increases whenever wing nut 23 rotates along short threaded pointed segment 20 towards anterior circular plate 18*c*. This mechanical compression creates (i) a water-proof seal of flexible cover 2 and (ii) a sturdy reversible mechanical manner by which to attach enclosed flag 11 and enclosing flexible cover 2 to (i) a protruding support 26 (such as a flag pole that attaches to upright surface 66) (ii) horizontal support(s) 54 or (iii) wall connectors 55. Retainer upper openings 19*a*, 19*b* are the structures by which enclosed flag 11 and the enclosing flexible cover 2 can reversibly attach to supports 26, 54 or wall connectors 55. Please see FIGS. 8A, 8C, 13A and 13AA.

D. Prior Art Spring Clamps 7

Referring to FIGS. 6B and 6C, in the preferred embodiment five prior art spring clamps 7 attach to adjacent lateral edges 2*a*, 2*b* and bottom distal edge 2*d* of flexible cover 2 when flag protection assembly 1 suspends from a horizontal support(s) 54 (such as an upper horizontal door surface or shower rod) or wall connectors 55 or protruding support 26. Each spring clamp 7 comprises first and second clamp ears 7*aa* and 7*ee* respectively. Clamp ears 7*aa*, 7*ee* are positioned downward for a more aesthetic appearance whenever spring clamps 7 are aligned along adjacent flexible cover edges 2*a*, 2*b* and 2*d* and compressed flag 11 at positions A, B, C, D, and E. Each spring clamp 7 is preferably approximately three-quarters inch in length and one-quarter inch in width w, and preferably each spring clamp 7 is identical in all respects to the other.

Spring clamps 7 maintain enclosed flag 11 in extended position and prevent flag edges 11*b*, 11*c*, 11*d* from receding from flexible cover edges 2*a*, 2*b* and 2*d*. The five spring clamps 7 are strategically placed along the flexible cover edges 2*a*, 2*b*, 2*d* and corresponding enclosed flag edges 11*b*, 11*c*, 11*d* simultaneously and thereby hold these paired corresponding edges together. First and second clamp ears 7*aa*, 7*ee* respectively are positioned upward for removal of spring clamps 7, as discussed infra. Preferably a single spring clamp 7 compresses and mechanically yet reversibly retains distal lower flexible cover edge 2*d* and distal lower flag edge 11*d* against each other in a compressed configuration.

In other embodiments diverse mechanical, adhesive, self-attaching or otherwise interlocking devices can maintain an extended enclosed flag position. In still other 15 embodiments, spring clamps 7 may be of (i) other dimensions or shapes, or other numbers and/or positions along flexible cover 2, or (ii) interspersed with other compressing devices. In still other embodiments there may be no devices for maintaining extension of enclosed flag 11.

E. Multiple Hook Attachments 69*a*, 69*b*

Figure 8A:
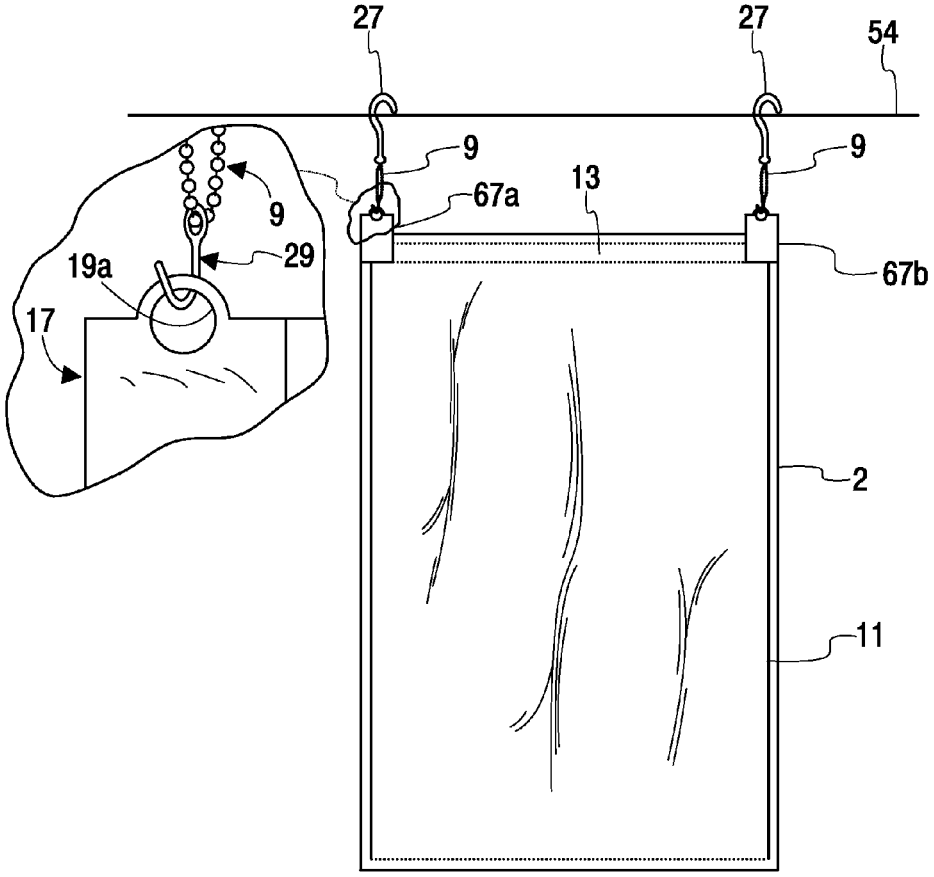
FIG. 8A illustrates an anterior view and close up isolated view of retaining devices attaching to a horizontal support with multiple hook attachments.

Referring to FIGS. 7 and 8A, in the preferred embodiment first and second multiple hook attachments 69*a*, 69*b* respectively [generically multiple hook attachments 69] attach flexible cover proximal edge 2*c* and enclosed flag upper proximal edge 11*a* to other attaching articles that in turn attach to flag supports 54, 55. Each multiple hook attachment preferably comprises a single large hook 27 and a single small hook 29. Each single large hook 27 and single small hook 29 preferably connect to each other by a single flexible closed chain loop 9 within a single hook attachment 69*a* or 69*b* respectively as the case may be. Each larger hook 27 is preferably made of durable plastic. Each small hook 29 is shaped and of dimensions to optimally insert into retaining device opening 19*a* or 19*b* in the preferred embodiment. This configuration of multiple hook attachments 69*a*, 69*b* is also particularly useful for aligning enclosed flag edges 11*b*, 11*c*, 11*d*, within enclosing flexible cover 2 during application of spring clamps 7.

Each large hook 27 is also optimally shaped and of appropriate dimensions to insert through or upon (i) a horizontal support or supports 54 such as an upper door surface or (ii) a wall connector 55 as described in more detail infra. Multiple hook attachments 69*a* or 69*b* are also useful for (i) maintaining enclosed flag 11 within flexible covering 2 during application of spring clamps 7, or (ii) for temporary support of an enclosed flag 11 and its enclosing flexible cover 2 along, for example, a substantially horizontal shower rod.

F. Wall Connectors 55

As illustrated in FIGS. 8B through 8H, flag protection assembly 1 can reversibly and mechanically attach to first and second wall connectors 55*a*, 55*b* [generically wall connectors 55], especially whenever wall connectors 55 attach to a wall or other substantially upright surface 66. In this configuration wall connectors 55 will support the flexible cover 2 and enclosed flag 11 so lower edge 11 *d* of flag 11 is substantially parallel to a substantially flat horizontal surface 80. Each wall connector 55 is preferably approximately (i) two and one-half inches in maximum height h (ii) one inch in depth d at upper portion A (iii) three-eights inches in depth at lower portion B, and (iv) one and one-half inches in height h2 of upper portion A. Each wall connector 55 preferably attaches to upright surface 66 with (i) first and second threaded screws 43*a*, 43*b* respectively through (ii) first and second threaded screw apertures 44*a*, 44*b* respectively, and (iii) corresponding first and second wall apertures 48*a*, 48*b* respectively.

First and second threaded screw apertures 44*a*, 44*b* respectively are (i) continuous and (ii) open exteriorly from wall connector anterior surface 77*j* to and through wall connector posterior upper wall connector surface 77*i*. Each wall connector 55 also has (i) an upper flat surface 77*e* (ii) a lower posterior flat surface 77*s* and (iii) an upper posterior flat surface 77*i*. Each wall connector 55 also has (i) a second partial lower flat surface 77*t* (ii) a first upper lateral surface 77*ii* (iii) a first lower flat lateral surface 77*g* (iv) a second upper lateral surface 77*k* and (v) a second lower lateral flat surface 77*h* and (vi) a lower posterior surface 77*d*. Anterior wall connector surface 77*j* also has a first lateral wall connector edge 77*m* and a second lateral wall connector edge 77*n*.

Each wall connector 55 is preferably made of a hard rigid plastic, and each threaded screw aperture 44*a*, 44*b* is preferably approximately one-quarter inch in diameter. First threaded screw aperture 43*a* is preferably approximately five-eighths inches from first lateral wall connector edge 77*m*, while second threaded screw aperture 44*b* is preferably approximately five-eighths inches from second lateral wall connector edge 77*n*. Each threaded screw aperture 44*a*, 44*b* is preferably (i) straight and continuous and (ii) opens into first anterior wall connector surface 77*j* and upper posterior wall connector surface 77*i*.

As best seen in FIGS. 8B and 8E, preferably located approximately fifteen sixteenths of an inch below threaded screw apertures 44*a*, 44*b*, and midway between threaded screw apertures 44*a*, 44*b*, is round aperture 40. Round aperture 40, first threaded screw aperture 44*a* and second threaded screw aperture 44*b* are each preferably approximately one-fourth inch in diameter. In the preferred embodiment large hook 27 respectively of corresponding multiple hook attachment 69*a* or 69*b* respectively attach to a wall connector 55*a*, 55*b* by insertion through two small flexible chains 9*a*, 9*b*. In turn, each small flexible chain 9 preferably comprises a smaller flexible closed loop through round aperture 40. Attachment of retainer device 67*a*, 67*b* respectively to wall connectors 55*a*, 55*b* respectively through (i) multiple hook attachments 69*a*, 69*b* respectively and (ii) smaller flexible chains 9*a*, 9*b* preferably complete the physical connection between flag protection assembly 1 and upright surface 66 when assembly 1 hangs from horizontal support(s) 54 or wall connectors 55.

III. Insertion, Expansion and Attachment of Flag 11 within Flexible Covering 2

Referring to FIG. 1A, to assemble flag protection assembly 1 the operator initially (i) places flag 11 upon a flat surface 80 (ii) with either first longitudinal flag surface 33*a* or second flag longitudinal surface 33*b* facing upward. He or she thereafter opens sliding attached zippers 3, 5 of flexible covering 2 as best seen in FIG. 2. Referring to FIG. 3A, the operator then places single short rod 8 (i) upon flag longitudinal side 33*a* or 33*b* (ii) perpendicular to the longitudinal length 1 of flag 11 and (iii) adjacent to flag distal bottom edge 11*d* (depending upon which flag longitudinal side 33*a*, 33*b* faces upwardly and away from horizontal surface 80). The operator next (i) coils flag 11 around single short rod 8, and (ii) continues to coil flag 11 around single short rod 8 toward upper proximal flag edge 11*a*.

As seen in FIG. 4 the operator continues until flag 11 is completely coiled around short rod 8, except for protruding flag webbing 13. The operator next preferably attaches first and second prior art spring clamps 7*a*, 7*b* respectively to (i) each first and second short rod ends 8*a*, 8*b* respectively and (ii) corresponding first and second coiled flag ends 11*e*, 11*f* respectively. Spring clamps 7*a*, 7*b* respectively (i) attach coiled flag ends 11*e*, 11*f* respectively to each short rod end 8*a*, 8*b* respectively and (ii) thereby temporarily maintain flag 11 in a coiled configuration around short rod 8. Referring to FIG. 5, the operator thereafter slides clamped coiled flag 11 upon single rod 8 into flexible covering interior 2*h* through first open sliding attached zipper 3 and second open attached zipper 5.

Figure 6A:
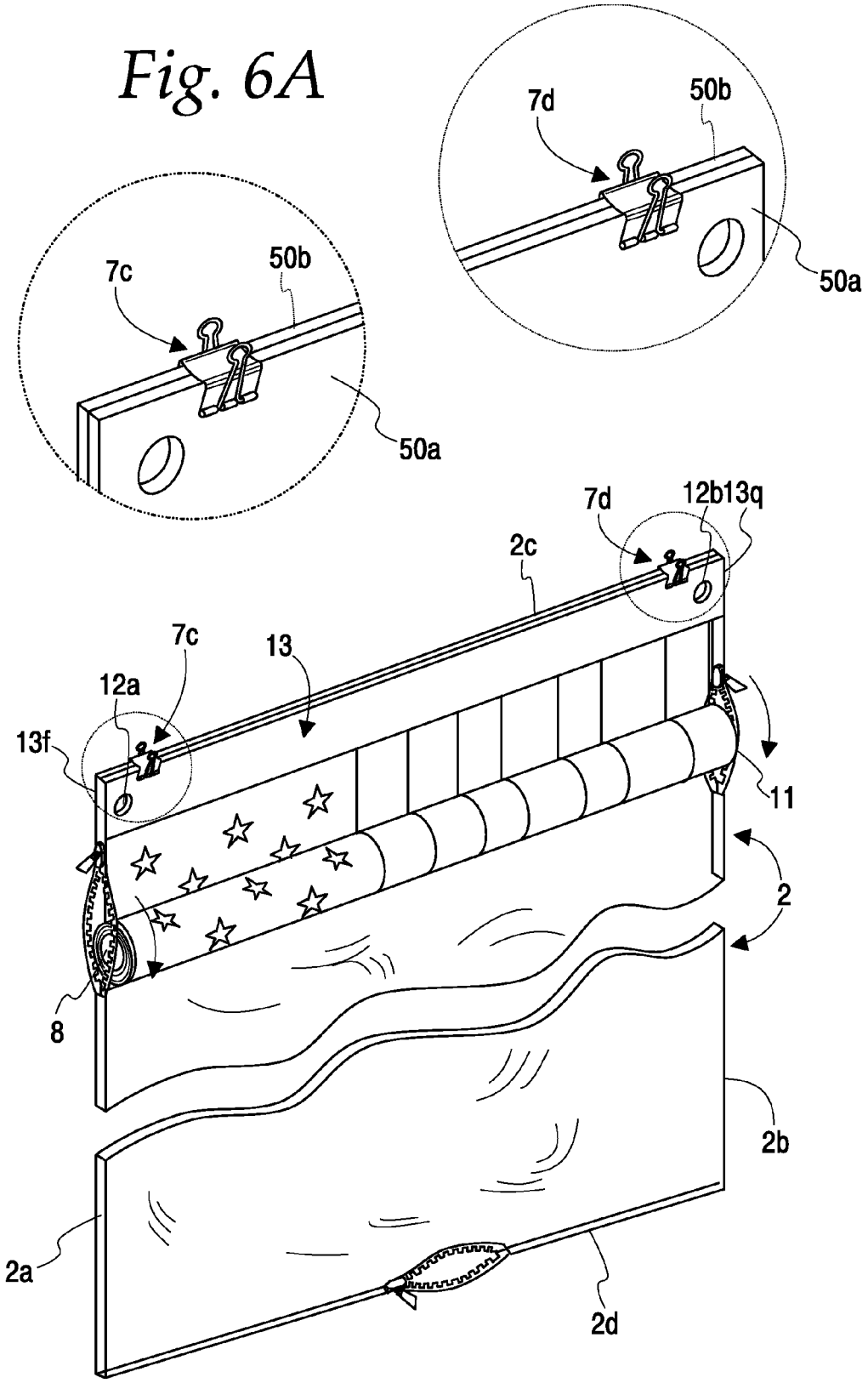
FIG. 6A illustrates uncoiling downward movement of a flag within flexible cover in the preferred embodiment, and spring clamps along the upper proximal edge of the enclosed-flag and enclosing flexible cover.

FIG. 6A illustrates the placement of flag webbing 13 (i) parallel to upper proximal flexible cover edge 2*c* and (ii) within interior 2*h* of flexible cover 2 and (iii) immediately prior to application of two spring lamps 7*c*, 7*d*. The two spring clamps 7*c*, 7*d* are applied to upper flag edge 11*a* and upper proximal flexible cover edge 2*c* to temporarily compress flag webbing 13 and flexible cover to each other. After spring clamps 7*c*, 7*d* are applied, flag webbing 13 is adjacent and parallel to upper proximal flexible cover edge 2*c* within flexible cover 2. The secured flag webbing configuration necessarily precedes the application of retainer devices 67*a*, 67*b* as illustrated within FIG. 10. FIG. 6A also illustrates an uncoiling downward movement of a flag 11 within flexible cover 2.

Referring to FIGS. 10 and 11A, the operator next preferably installs the first and second retaining devices 67*a*, 67*b* by positioning short threaded pointed segment 20 along a straight linear retainer axis 21 preferably perpendicular to flag assembly 1 longitudinal flexible cover 2 surfaces 50*a*, 50*b* and flag eyelets 12*a*, 12*b*. Accordingly, the linear retainer axis 21 is identified by a line segment beginning at the posterior of plate 17 while passing through the central axis of threaded pointed segment 20, engaging the center opening of flag eyelets 12 *a* or 12*b*, and the center openings of all retaining device 67*a* or 67*b* components. The linear retainer axis line segment ends at a point immediately beyond the center opening of threaded wing 23. The operator thereafter presses short threaded segment 20 along retainer axis 21 with pointed segment end 20*a* initially traversing first circular pliable plate 18*a*. Short threaded segment 20 then severs flexible cover longitudinal cover surface 50*b* to traverse flag eyelet 12*a* or 12*b* as the case may be. Short threaded pointed segment 20 thereafter (i) severs flexible longitudinal cover surface 50*a* and (ii) thereafter traverses circular pliable plate 18*b*, anterior circular plate 18*c*, and finally lock washer 22 and threaded wing nut 23 respectively. Preferably flag eyelet 12*a* or 12*b*, each center opening 88 of each corresponding plate 18*b* and 18*c*, center opening 88*a* of plate 18*a*, center opening 22*a* of lock washer 22 and center opening 23*a* of wing nut 23 are congruently aligned with each other along retainer axis 21. Short threaded pointed segment 20 of plate 17 is also congruently aligned with flag eyelet 12*a* or 12*b*, center openings 88, opening 88*a*, center openings 22*a* and center opening 23*a* along retainer axis 21.

In this manner described immediately supra, shorted threaded pointed segment 20 (segment 20 is also preferably rigid) can easily traverse each component of retainer device 67*a*, 67*b* as the case may be. Tightening of wing nut 23 and lock washer 22 completes installation of retaining devices 67*a*, 67*b* through flexible cover 2 and enclosed flag 11. Retaining devices 67*a*, 67*b* mechanically retain longitudinal flexible cover longitudinal sides 50*a*, 50*b* respectively with flag 11 tightly sandwiched between flexible cover longitudinal sides 50*a*, 50*b*. The operator next removes first and second spring clamps 7*c*, 7*d* respectively that remain attached to first and second coiled flag ends 11*e*, 11*f*. The operator next grasps retaining devices 67*a*, 67*b* at proximal edge 2*c* and swings enclosed flag 11 and flexible cover 2 rapidly with an up and down motion. This swinging plus gravity pulls short rod 8 with coiled flag 11 downward, while flag 11 remains mechanically attached to upper proximal flexible cover edge 2*c* by retaining devices 67*a*, 67*b* in the preferred embodiment. Within flexible cover 2 flag 11 rapidly uncoils to its full extended length to distal bottom flexible cover edge 2*d*. To hasten the uncoiling process, the operator may continue to swing or flap enclosed rolled flag 11 within flexible covering 2 until longitudinal extension of flag 11 is complete. Please see FIG. 9.

During the uncoiling process described immediately supra, short rod 8 falls to distal lower edge 2*d* where it is removed through distal flexible opening 30*d* with sliding attached zipper 6. The operator now closes sliding attached zippers 3, 5, 6 and applies transparent adhesive tape to each longitudinal cover opening 30*a*, 30*b*, and 30*d* to effectively seal enclosed flag 11. When flag 11 is displayed in a horizontally or downward configuration as seen in FIG. 8A or 8C (either permanently or temporarily) the operator applies five spring clamps 7 to the corresponding adjacent lateral edges 2*a*, 2*b*, 2*d* respectively and 11*b*, 11*c*, 11 *d* of flexible cover 2 and flag 11 respectively. Please also see FIG. 6C at points A, B, C, D and E. Flag 11 is thereby preferably and reversibly held in place by spring clamps 7 at points A through E and retaining devices 67*a*, 67*b* attached to upper flexible cover edge 2*c* and flag webbing 13. The five spring clamps 7 remain in place during flight of the enclosed flag 11 and enclosing flexible cover 2 from a protruding support 26 such as that of FIG. 13B.

In summary, flag protection assembly 1 in combination with enclosed flag 11 are now ready for attachment to a horizontal support(s) 54, a support 26 that protrudes from a substantially vertical surface 66, or wall connectors 55. During use attached zippers 3, 5, 6 are preferably completely closed to protectively seal flag 11 within flexible cover 2. The operator also removes any temporary positioned spring clamps 7 along upper flag edge 11*a* and upper flexible cover edge 2*c*. To remove enclosed flag 11 from flexible cover 2 in the preferred embodiment, the operator loosens the winged nut 23 and washer 22 of each retainer device 67*a*, 67*b*. The operator thereafter removes each retainer device 67*a*, 67*b* respectively from enclosed flag eyelets 12*a*, 12*b* respectively and flexible cover surfaces 50*a*, 50*b* respectively. The operator next removes five spring clamps 7 that compress enclosed flag 11 between flexible longitudinal cover surfaces 50*a*, 50 *b*. Please see FIG. 6C. The operator thereafter pulls enclosed flag 11 to the exterior of flexible cover 2 through bottom horizontal opening 30*d* by opening attached zipper 6.

IV. Attachment of Enclosing Flexible Cover 2 with Enclosed Flag 11 to Flag Supports 26, 54 and Wall Connecters 55

Figure 12D:
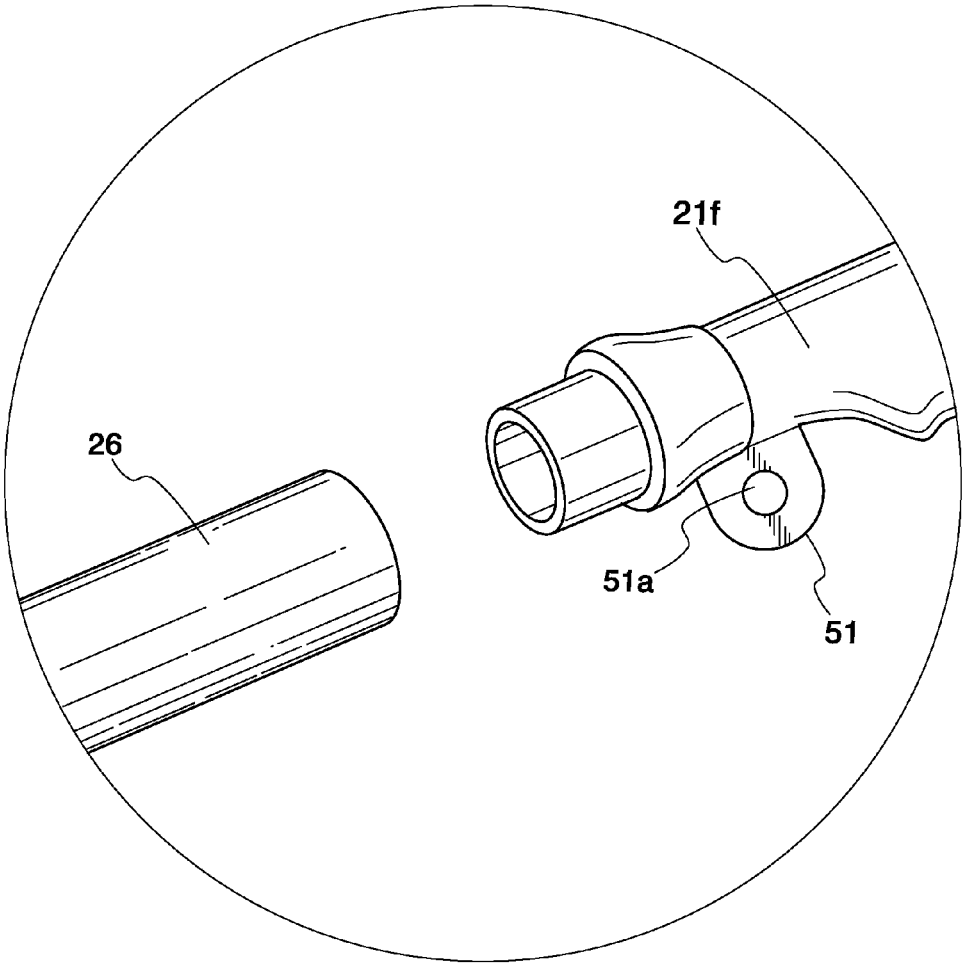
Fig. 12D PRIOR ART
FIG. 12D illustrates a close up exploded view of a prior art upper support cap and the protruding support to which it attaches.

As seen in FIGS. 12C, 13A, 13AA, 13B and 14, in the preferred embodiment enclosing flexible cover 2 with enclosed flag 11 attaches to a protruding support 26 with (i) conventional prior art flag clips 44 (ii) retaining devices 67*a*, 67*b* and (iii) connecting devices originating upon protruding support 26. Most preferably a flag clip 44 connects to a single prior art cylindrical flexible open clamp 64 and retainer opening 19*a* or 19*b* with a protruding support 26. Please see FIGS. 12A through 12D for illustration of prior art cylindrical flexible clamps 64, prior art upper cap 21*f*, and flag clips 44 inserting within prior art flag grommets 75.

As seen in FIGS. 12B, 12C, and 13A, each cylindrical flexible open clamp 64 may preferably (i) reversibly and partially mechanically encircle a protruding cylindrical support 26 (such as a flag pole) (ii) while engaging a flag clip 44 that in turn inserts through a single retainer opening 19*a* or 19*b* as the case may be. Upper cap 21 *f* is a removable prior art upper component of a corresponding protruding support 26. In the preferred embodiment, for the uppermost attaching position on a protruding support 26 prior art removable upper cap 21 *f* comprises an integral protrusion 51. Protrusion 51 contains an opening 51*a* through which preferably a single flag clip 44 (i) reversibly inserts while (ii) simultaneously inserting through retaining device 67*a* or 67*b* (when retaining device 67*a* is preferably structurally interchangeable with retaining device 67*b*).

Referring to FIGS. 7 and 8A, for alignment of flag protection assembly 1 along a substantially horizontal support (s) 54, first and second small hooks 29*a*, 29*b* respectively of multiple hook attachments 69*a*, 69*b* respectively are inserted through retainer device openings 19*a*, and 19*b* respectively. Each corresponding large hook 27*a*, 27*b* is then placed upon or through horizontal support(s) 54 such as an upper door edge, shower curtain rod (and by which shower curtain rod can function as temporary support for enclosed flag 11 and enclosing flexible cover 2), or opposing horizontal surfaces 54.

Referring to FIGS. 7, 8B, 8C and 8D for attachment to wall connectors 55, first and second small hooks 29*a*, 29*b* respectively preferably insert through corresponding retainer openings 19*a*, 19*b* respectively (or vice versa since multiple hook attachments 69*a*, 69*b* are structurally interchangeable). Each corresponding small flexible chain 9*a* simultaneously inserts through round aperture 40 within a single corresponding wall connector 55*a* or 55*b*. Each wall connector 55 *a*, 55*b* attaches to wall or other upright surface 66 with first and second screws 43*a*, 43*b* through (i) threaded screw apertures 44*a*, 44*b* and (ii) corresponding wall apertures 48*a*, 48*b* respectively. Either first or second large hooks 27*a*, 27*b* respectively inserts into a corresponding wall connector flexible chain 9*a* for support of the enclosed flag 11 within the flexible cover 2.

Flexible cover 2 with enclosed flag 11 is preferably stored by suspension from multiple hook attachments 69*a*, 69*b* attached to wall connectors 55*a*, 55*b* in the manner described immediately supra. During storage and flight attached zippers 3, 5, 6 are preferably covered with transparent plastic adhesive tape to extend the useful lifetime of flexible cover 2 utility by preventing zipper disengagement by ultraviolet light damage. This detailed description of my flag protection assembly 1, its assembly and use in no manner limits the spirit or scope of the additional accessories that are compatible and within the scope of my invention.

Figure 15:
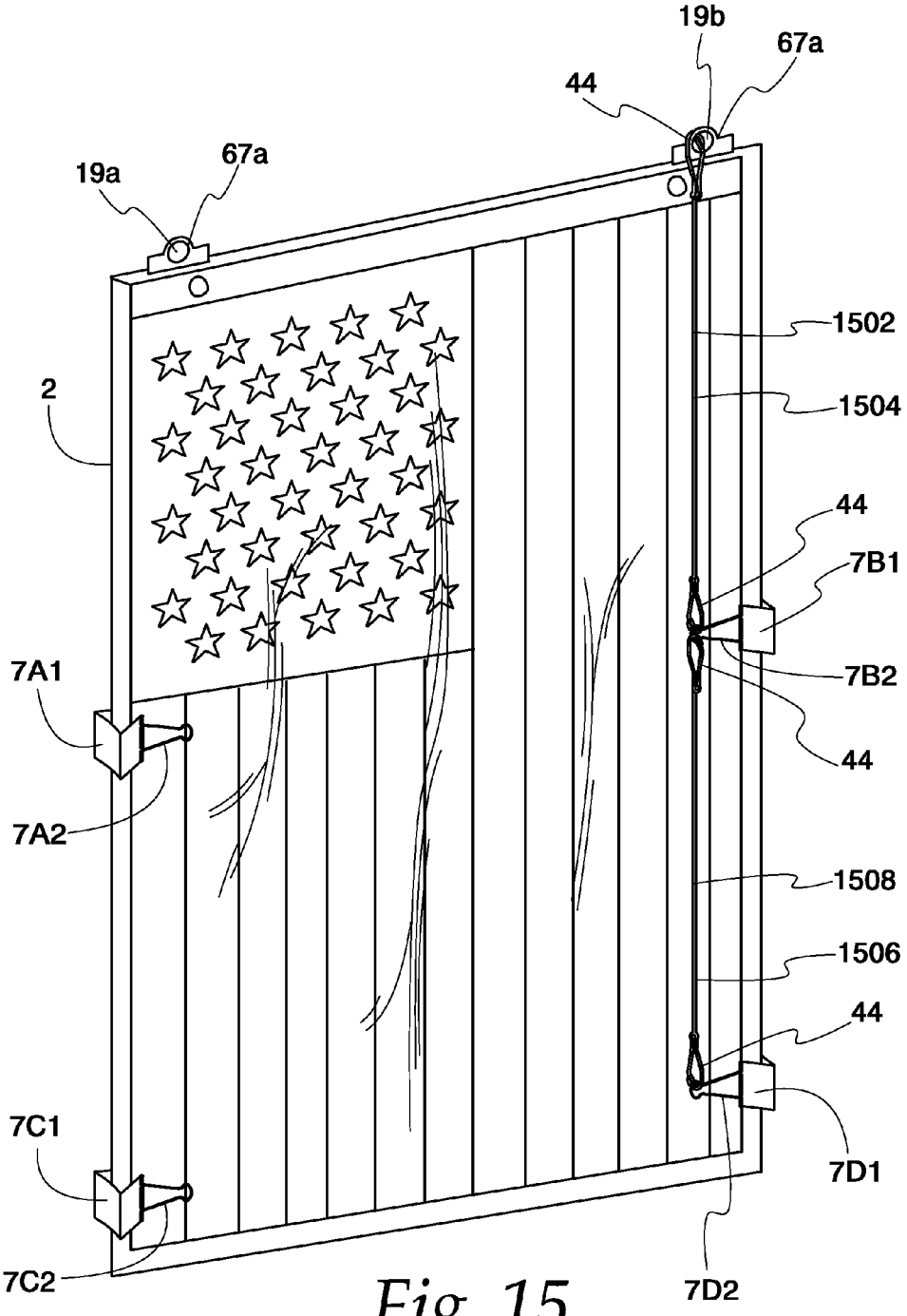
FIG. 15 is a perspective view of a flag protection assembly with a set of clamps and a set of fastening devices connecting the set of clamps to a set of retaining devices in accordance with the present teachings.

Referring now to FIG. 15, a set of four clamps 7A1, 7B1, 7C1 and 7D1 are positioned at the positions A, B, C and D (shown in FIG. 6C). The set of clamps 7A1, 7B1, 7C1 and 7D1 maintain the flag 11 in an extended position inside the flag cover 2. To prevent the clamps 7B1 and 7D1 from falling off the flag cover 2, a set of fastening devices 1502 and 1506 are used to connect the clamps 7B1 and 7D1 with the retaining device 67*b*. The fastening devices 1502 and 1506 each include a pair of flag clips 44 attached to two cords 1504 and 1508 respectively. In one implementation, the two cords 1504 and 1508 are flexible cords, such as two bungee cords. The two flag clips 44 of the fastening device 1506 are attached to the clamp ear 7B2 of the clamp 7B1 and the clamp ear 7D2 of the clamp 7D 1 respectively. One flag clip 44 of the fastening device 1502 is attached to the clamp ear 7B2, while the other flag clip 44 is attached to the retaining device 67*b* through the opening 19*b* of the retaining device 67*b*.

Similarly, two additional fastening devices are used to connect the claims 7A1 and 7C1 to the retaining device 67*a*. In one embodiment, the fastening devices 7B1 and 7D1 are position on the front side of the flag cover 2, while the other two fastening devices connecting the clamps 7A1 and 7C1 are positioned on the back side of the flag cover 2. It should be noted that any of the fastening devices can be positioned on either the front or the back side of the flag cover 2.

Figure 16A:
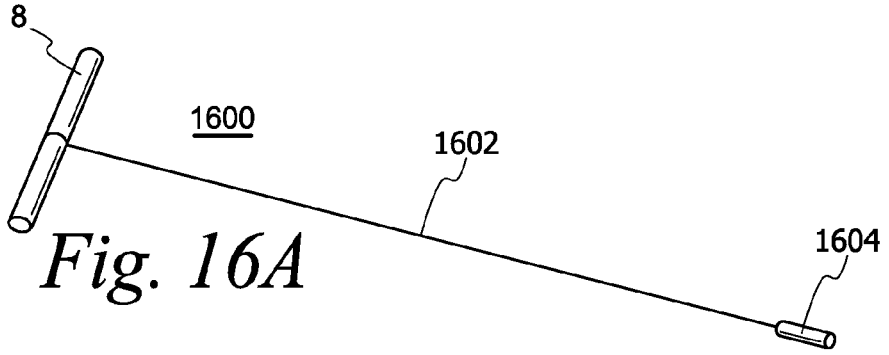
FIG. 16A is a perspective view of a flag extending assembly including a rod, a cord and a cord handle in accordance with the present teachings.
Figure 16B:
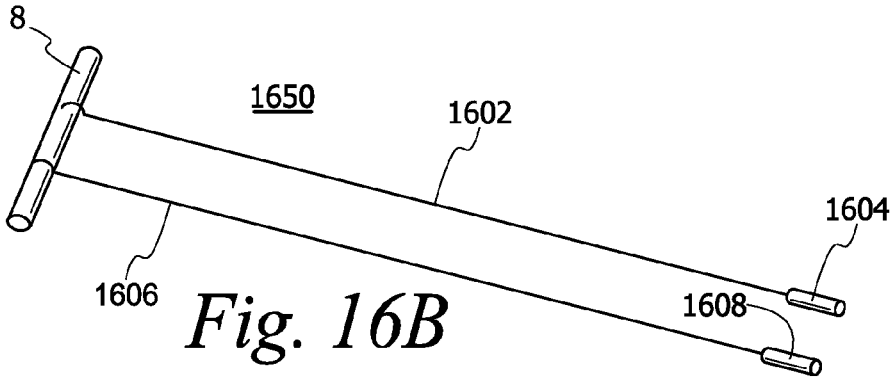
FIG. 16B is a perspective view of a flag extending assembly including a rod, two cords and two cord handles in accordance with the present teachings.

Referring to FIGS. 16A, 16B, 17, 18 and 19, a flag extending assembly is further illustrated. Turning first to FIG. 16A, a flag extending assembly 1600 includes the short rod 8, a flexible cord 1602 attached to the middle of the rod 8, and an optional handle 1604 attached to the cord 1602. Alternatively, the flag extending assembly 1600 incorporates more than one cord. For example, a flag extending assembly 1650 including two cords 1602 and 1606 attached to the rod 8 is illustrated in FIG. 16B. To maintain balance when the flag 11 is extended inside the flag cover 2, the two cords 1602 and 1606 are positioned from the respective closest end of the rod 8 with equal distance.

Figure 17:
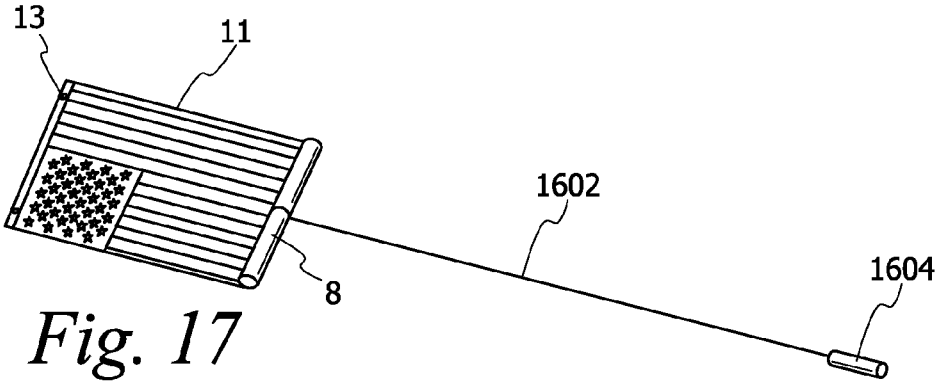
FIG. 17 is a perspective view of a flag coiled with a flag extending assembly in accordance with the present teachings.
Figure 18:
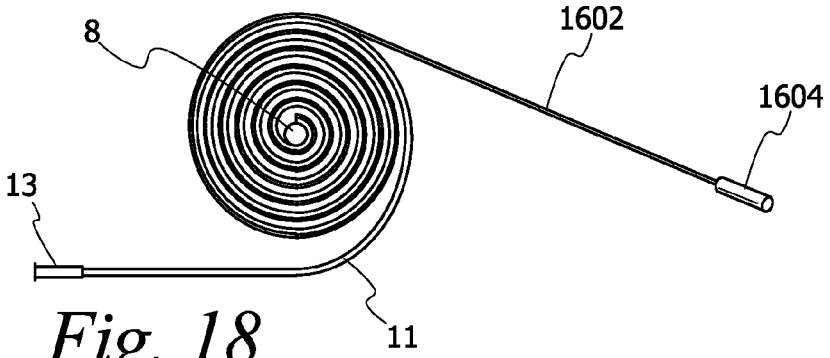
FIG. 18 is a side cross-sectional view of a flag coiled with a flag extending assembly in accordance with the present teachings.

FIG. 17 illustrates how the flag extending assembly 1600 is used with the flag 11. First, the rod is aligned with and placed on top of the bottom end (opposite from the flag webbing 13) with the cord 1602 stretched and extended away from the flag 11. Thereafter, the bottom end of the flag 11 is rolled around the rod 8 and toward the flag webbing 13. In other words, the flag 11 is coiled around the rod 8. While the flag 11 is rolled toward the flag webbing 13, the cord 1602 is rolled as well. FIG. 18 illustrates a side cross-sectional view of the flag 11 and the flag extending assembly 1600 after the flag 11 and the cord 1602 are coiled together. The flag 11 and the flag extending assembly 1600 then form a bundle.

Figure 19:
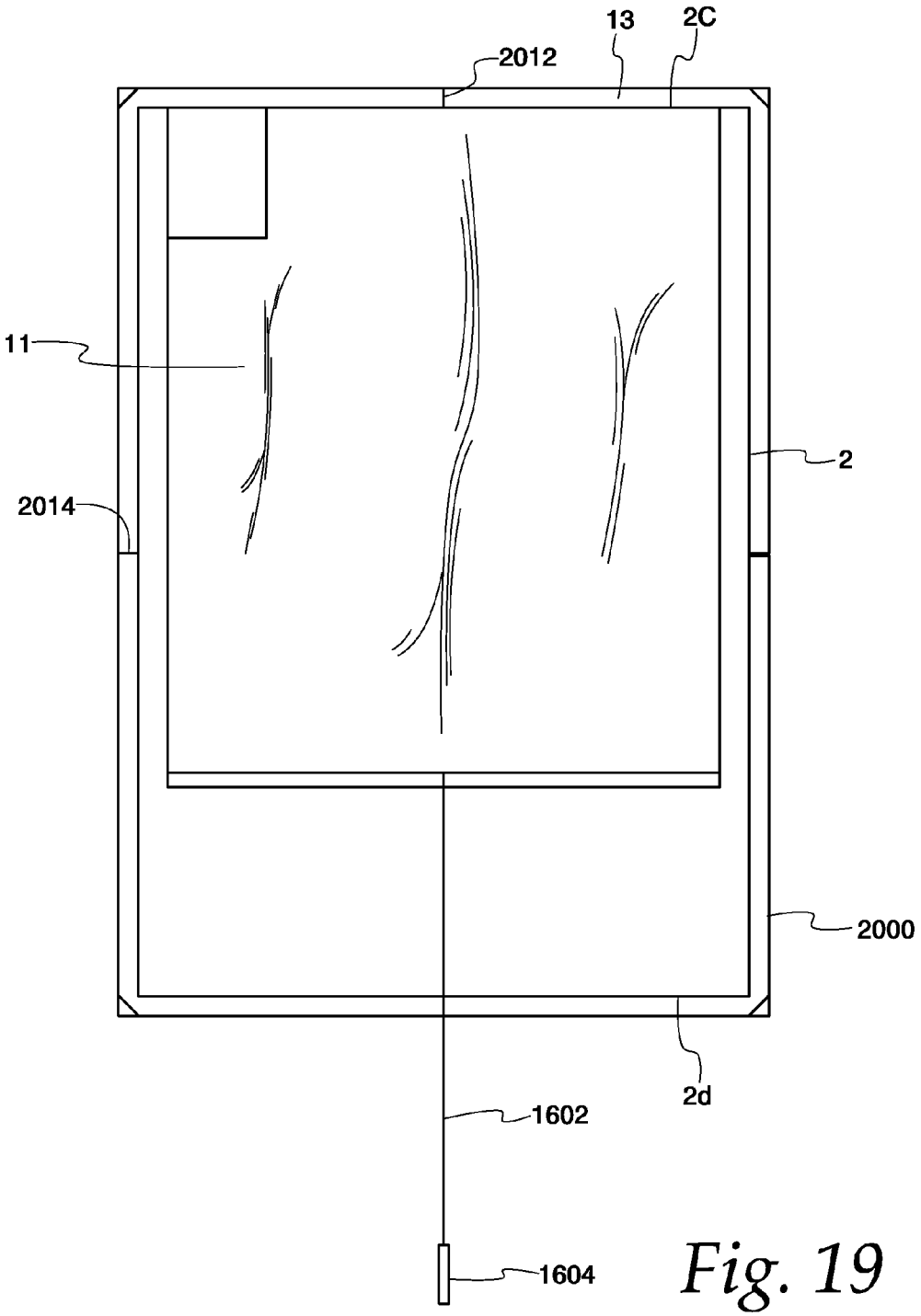
FIG. 19 is a top view of a flag protection assembly and a flag extending assembly resting on a foldable board in accordance with the present teachings.

To extend the flag 11 inside the cover 2, the bundle is inserted into the interior of the flag cover 2 through the cover longitudinal opening 30*a* or 30*b*. FIG. 5 illustrates a perspective view of the flag 11 after its inserted into the flag cover 2. It should be noted that FIG. 5 does not show the cord 1602 or the handle 1604. As shown in FIG. 19, the flag cover 2 is placed on top of a foldable board 2000. To prevent the free movement of the flag cover 2 over the foldable board 2000, a user can secure the flag cover 2 to the foldable board 2000 by, for example, two clamps that temporarily bind the flag edge 2*c* to the foldable board 2000.

The user then insert one hand into the flag cover through the distal flexible opening 30*d* to grab and hold the handle 1604. Thereafter, he pulls the handle toward the lower distal edge 2*d*, and away from the flag cover 2 to uncoil the flag 11. After the flag 11 is fully extended and uncoiled inside the flag cover 2, the rod 8 becomes loose, and is removed from the flag cover 2 through the distal flexible opening 30*d*. In other words, after the flag 11 is fully extended inside the flag cover 2, the flag extending assembly 1600 is removed from the flag 11 and the flag cover 2. The zippers 3, 5 and 6 are then closed. To keep the flag 11 in the extended positions, the clamps 7A1, 7B1, 7C1 and 7D1 are applied at the positions A, B, C and D (shown in FIG. 6C). In addition, the fastening devices 1502 and 1506 are deployed as shown in FIG. 15.

Figure 20:
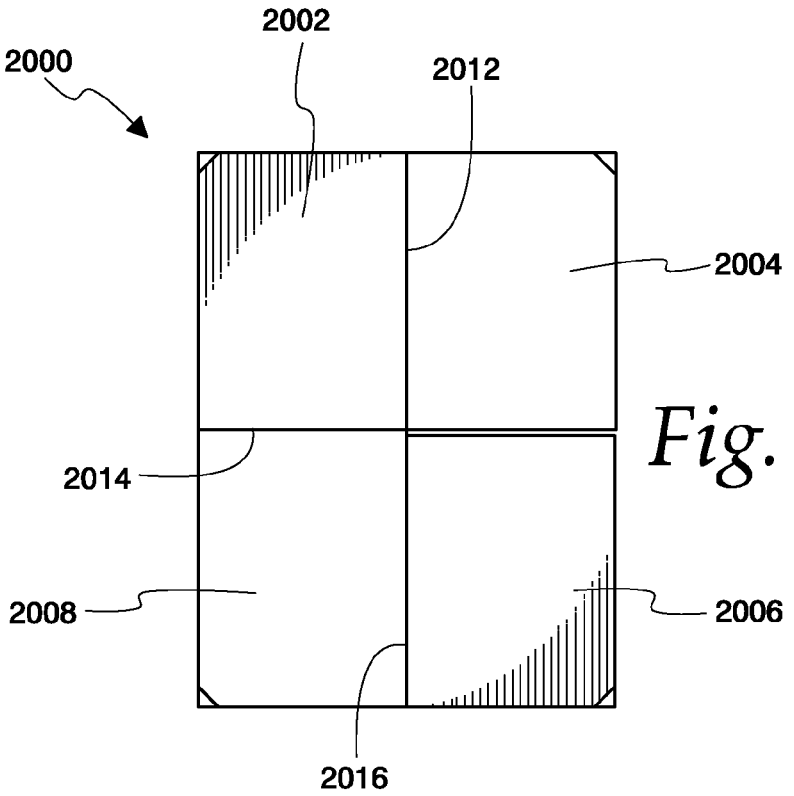
FIG. 20 is a top view of a foldable board for extending a flag inside a flag cover in accordance with the present teachings.

The foldable board 2000 is further illustrated by reference to FIGS. 20 and 21. The foldable board 2000 includes four foldable quadrants 2002, 2004, 2006 and 2008. The quadrant 2002 is operatively coupled to the quadrants 2004 and 2008 through foldable joints 2012 and 2014 respectively. The quadrant 2006 is operatively coupled to the quadrant 2008 through a foldable joint 2016. The joints 2012, 2014 and 2016 are flexible to allow the board 2000 to be folded into a form that is one-fourth of the area of the board 2000 in the extended form as shown in FIG. 19. In one implementation, the quadrant 2004 and the quadrant 2006 are disjoined. In other word, there is no joint between the quadrant 2004 and the quadrant 2006.

Figure 21:
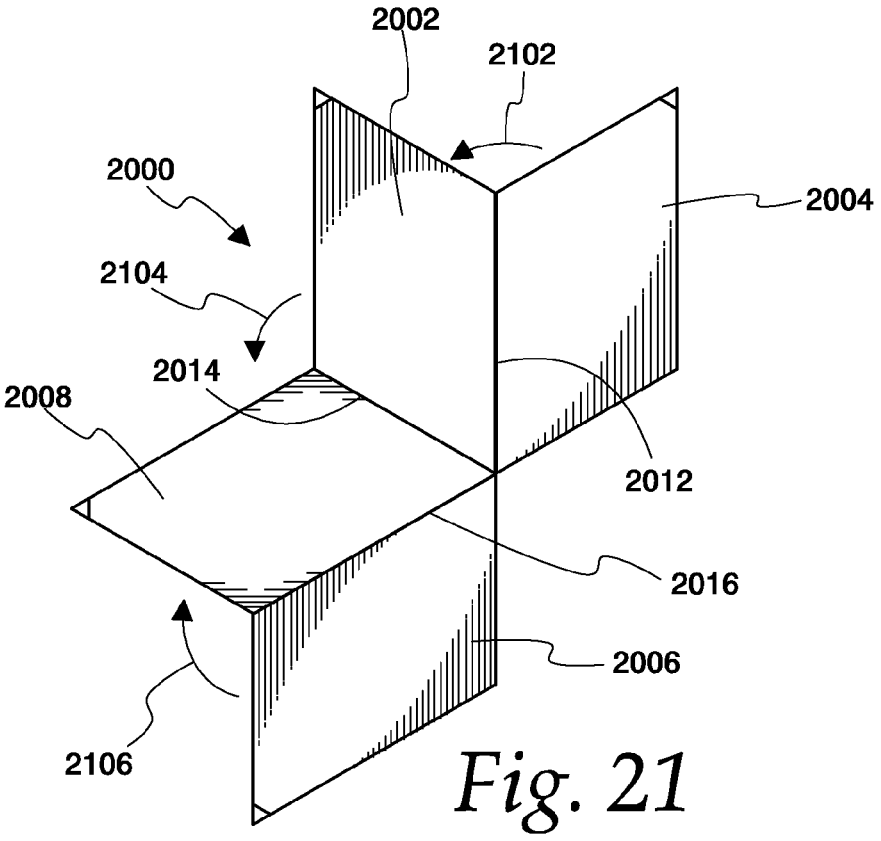
FIG. 21 is a perspective view of a foldable board for extending a flag inside a flag cover in accordance with the present teachings.

FIG. 21 illustrates an operation to fold the board 2000. The quadrant 2004 is folded toward the quadrant 2002 in a direction indicated at 2102; the quadrant 2006 is folded toward the quadrant 2008 in a direction indicated at 2106; and the quadrant 2002 is folded toward the quadrant 2008 in a direction indicated at 2104. After the board 2000 is folded (meaning in a folded form), the quadrant 2004 rests on top of the quadrant 2002; the quadrant 2002 rests on top of the quadrant 2008; and the quadrant 2008 rests on top of the quadrant 2006.

Figure 22:
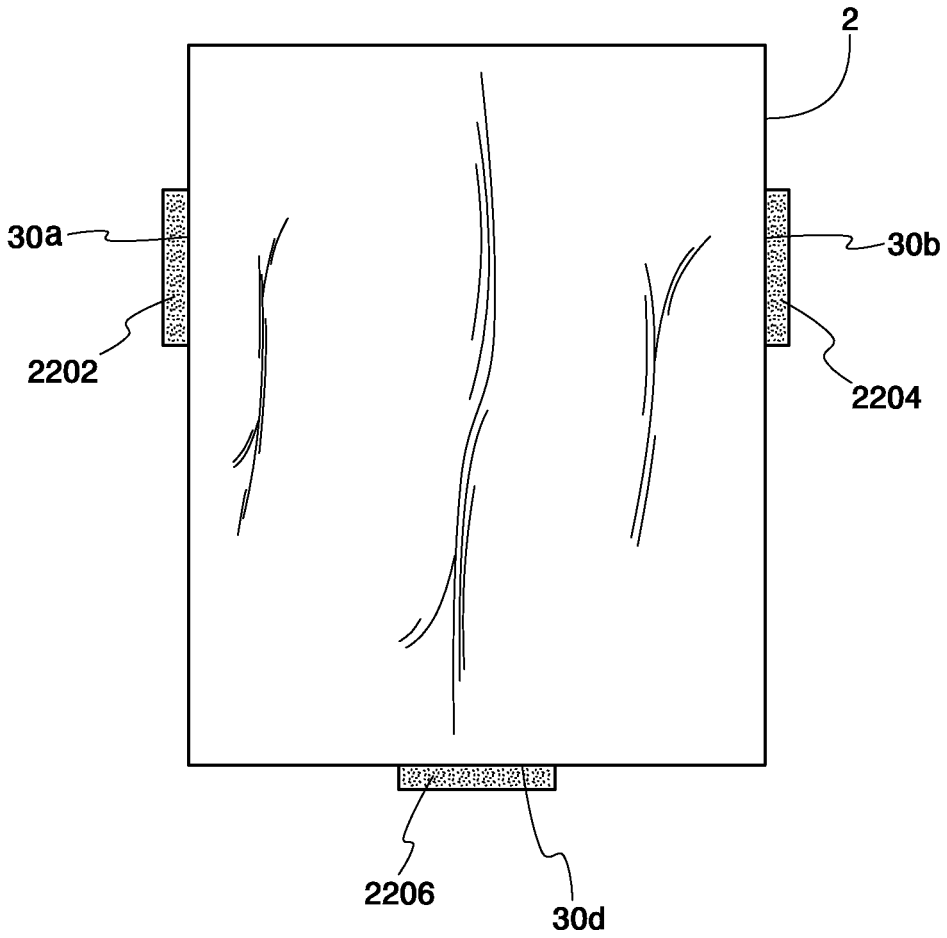
FIG. 22 is a top view of a flexible cover of a flag protection assembly that incorporates three sealing flaps.

FIG. 22 illustrates a further implementation of the flexible cover 2 incorporating three sealing flaps 2202, 2204 and 2206. The sealing flaps 2202, 2204 and 2206 extend from the bottom side of the cover 2 at the positions of the three openings 30*a*, 30*b* and 30*d* respectively. Each of the sealing flaps 2202, 2204 and 2206 contains adhesive material on its inside surface. The length of each of the sealing flaps 2202, 2204 and 2206 is longer than the length of its corresponding opening. For example, along the right lateral edge of the cover 2, the length of the flap 2204 is longer than the length of the opening 30*b*. When the flap 2204 is folded along the right lateral edge of the cover 2, and pressed against the front surface of the cover 2, the inside surface of the flap 2204 engages with the front surface of the cover 2. The adhesive material on the flap 2204 then seals the opening 30*b*. Similarly, the sealing flaps 2202 and 2206, when folded, seal the openings 30*a* and 30*d* respectively.

Obviously, many additional modifications and variations of the present disclosure are possible in light of the above teachings. Thus, it is to be understood that, within the scope of the appended claims, the disclosure may be practiced otherwise than is specifically described above. For example, the quadrant 2004 is operatively coupled to the quadrant 2006 through a foldable joint.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A flag protection assembly comprising a cover, said cover comprising one or more lateral openings and a distal bottom opening, said flexible cover adapted to enclose a flag, said cover further adapted to be attached to a flag support while enclosing said flag, said cover further adapted to maintain said flag in an extended position.

2. The flag protection assembly of claim 1, wherein said cover comprises a set of opening zippers adapted to open and close said openings.

3. The flag protection assembly of claim 1 further comprising a flag extending assembly, said flag extending assembly comprising a rod and a set of flexible cords attached to said rod, said rod adapted to be aligned with a bottom end of said flag and coiled with said flag.

4. The flag protection assembly of claim 3, wherein said set of flexible cords consists of one flexible cord, wherein said one flexible cord is attached to said rod, and said cord attached to a handle, said handle adapted to pull said cord to uncoil said flag inside said cover.

5. The flag protection assembly of claim 1 further comprising:

i. a set of clamps adapted to maintain said flag in said extended position within said cover;

ii. at least two retaining devices adapted to maintain said flag in said extended position within said cover; and iii. a set of fastening devices adapted to connect said set of clamps to said at least two retaining devices.

6. The flag protection assembly of claim 5, wherein each fastening device within said set of fastening devices includes a cord and two flag clips attached to two ends of said cord respectively.

7. The flag protection assembly of claim 6, wherein said cord is a bungee cord.

8. A method of protecting and presenting a flag comprising:

i. coiling said flag upon a short rod attached to a flexible cord, said flag comprising an upper proximal flag edge, said upper proximal flag edge comprising a flag webbing and a longitudinal length, said short rod having a longitudinal axis, said longitudinal axis positioned parallel to said upper proximal edge of said flag and perpendicular to said longitudinal length of said flag, said flexible cord attached said short rod at one end and attached to a handle at an opposite end;

ii. sliding said coiled flag, said short rod and said handle into a flag cover through a lateral opening of said flag cover;

iii. pulling said handle away from said flag cover through a distal bottom opening of said flag cover to uncoil said flag; and iv. removing said short rod and said cord from said flag cover.

9. The method of claim 8, wherein said flag cover is placed on and secured to a foldable board while said flag is being uncoiled inside said flag cover.

* * * * *